US006648190B1

(12) United States Patent
Manini

(10) Patent No.: US 6,648,190 B1
(45) Date of Patent: Nov. 18, 2003

(54) EQUIPMENT FOR THE INSPECTION AND STEAM PRESSING OF KNITTED PRODUCTS

(75) Inventor: Benito Manini, Florence (IT)

(73) Assignee: S.R.A. Saldatrici Rotative Automatiche S.R.L., Florence (IT)

( * ) Notice: Subject to any disclaimer, the term of this patent is extended or adjusted under 35 U.S.C. 154(b) by 0 days.

(21) Appl. No.: 09/857,251

(22) PCT Filed: Oct. 8, 1999

(86) PCT No.: PCT/IT99/00314

§ 371 (c)(1),
(2), (4) Date: May 30, 2001

(87) PCT Pub. No.: WO00/37728

PCT Pub. Date: Jun. 29, 2000

(30) Foreign Application Priority Data

Dec. 18, 1998 (IT) ..... FI98A0272

(51) Int. Cl.[7] ..... D06C 5/00
(52) U.S. Cl. ..... 223/76
(58) Field of Search ..... 223/76, 75, 60; 38/7, 8

(56) References Cited

U.S. PATENT DOCUMENTS 1,634,237 A 6/1927 Sibson
2,487,764 A 11/1949 Prosser
3,319,849 A 5/1967 Horberg, Jr.
5,458,265 A * 10/1995 Hester et al. ..... 198/350
5,709,326 A * 1/1998 Frohlich ..... 223/76

FOREIGN PATENT DOCUMENTS

| | | |
|---|---|---|
| DE | 935 901 | 6/1955 |
| GB | 774 797 A | 5/1957 |
| GB | 2 181 465 A | 4/1987 |
| WO | WO 97/35059 | 9/1997 |

* cited by examiner

*Primary Examiner*—John J. Calvert
*Assistant Examiner*—James G Smith
(74) *Attorney, Agent, or Firm*—McGlew and Tuttle, P.C.

(57) ABSTRACT

The equipment comprises a carousel (2) provided with a plurality of forms (3) designed to receive the products and stations, outside the carousel, for the loading and inspection (9) of the product, for setting (11) in a chamber and for discharge (13). On the carousel there are provided a plurality of units, each having guide means (29) for the radial sliding of a sliding support (31) on which the corresponding form (3) lies in a radial plane. Each of the stations (9, 11, 13) comprises a servo mechanism capable of moving said support to the outside of the carousel or in the opposite direction.

26 Claims, 20 Drawing Sheets

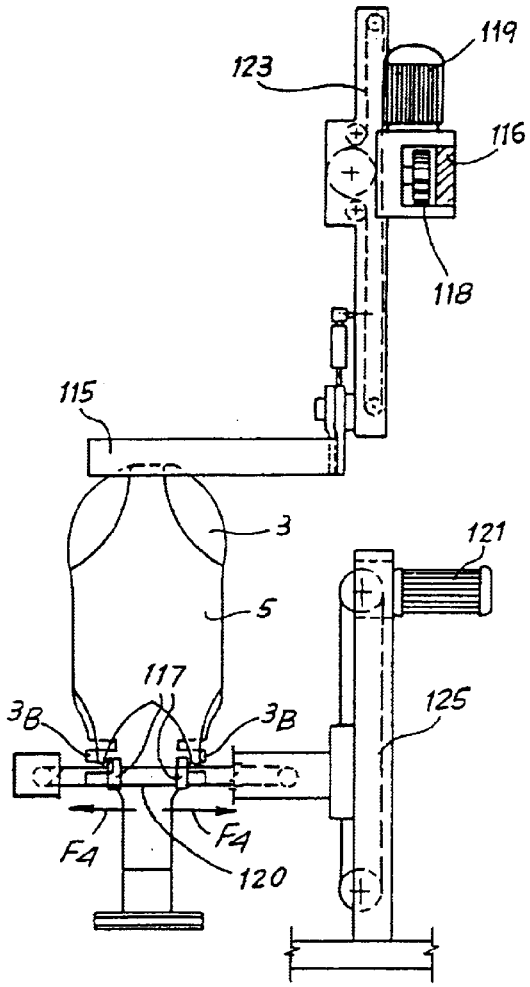
Fig.11
Fig.12
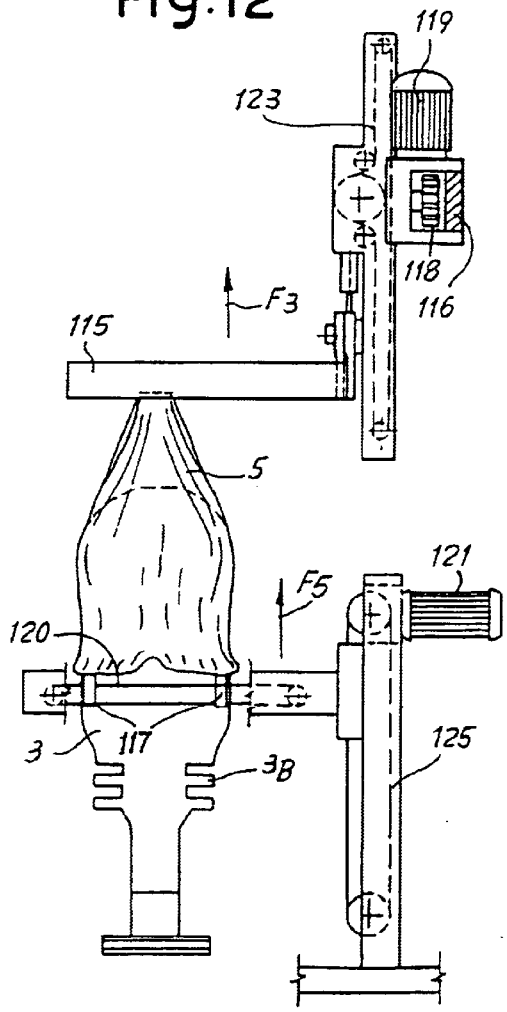

EQUIPMENT FOR THE INSPECTION AND STEAM PRESSING OF KNITTED PRODUCTS

The invention relates to equipment for the inspection and steam pressing of knitted products such as pantyhose, bodies and similar. Generally, known equipment of this type, such as that described in Patent Application No. F196A 56 filed on Mar. 19, 1996 (=WO 97/35059) in the name of the present applicant for treating pantyhose, comprises a carousel on the periphery of which are mounted a plurality of forms capable of holding the products to be tested and/or set; the carousel rotates with an intermittent motion to bring each of the forms in succession to stations for loading and inspecting the product, for setting in a chamber, for drying and for discharge, these operations normally being carried out with the forms fitted on the carousel. For ease of insertion and inspection of the products, the forms are mounted in a corresponding plane tangential to the carrying movement of the carousel. This arrangement, however, limits the number of forms which can be mounted on the carousel, according to the overall dimensions of the machine and the treatment time required for the product, to an extent which increases with the width of the form.

The object of the present invention is to overcome this limitation, particularly for knitted undergarments such as singlets, bodies, underpants and similar, which, being formed from yarns of natural fibers having a suitable count, require treatment times, particularly for setting and drying, which are considerably longer than those allowed for women's lightweight pantyhose made from synthetic fibers.

The equipment according to the present invention comprises, on the carousel, a plurality of units positioned close to each other, each forming guide means for the radial sliding of a support on which the corresponding form lies in a plane which is approximately radial with respect to the carousel. Work stations with apparatus for loading and inspection, for setting and for discharge are provided outside the carousel. At each of these stations, a radial extraction servo mechanism extracts one form radially from the carousel and reinserts it into the carousel after the operation specific to the station has been carried out. With this radial arrangement of the forms, the carousel can carry within given overall dimensions a number of forms which is markedly higher than that found in the known equipment.

Said units positioned close to each other for supporting the forms are distributed uniformly on the periphery of the carousel and said work stations are spaced angularly from each other by a multiple of the angular interval of said units.

Moreover, because of the radial arrangement of the forms, an oven, which is superimposed on the carousel and forms part of the equipment, and through which the forms pass with the products which have been previously steam-treated in a setting station, is able to contain a considerably larger number of forms than that found in the known equipment. Since the carousel advances by one step in the time required for the product to be loaded onto the form and inspected, the product treatment time in the oven is thus increased for the same overall dimensions, a circumstance which is particularly useful in the case of said knitted undergarments.

In a preferred embodiment of the invention, the equipment comprises a setting apparatus, extending in the form of two half-shells (to form the setting chamber) capable of housing the form, which is orientated and moves in a radial plane with respect to the axis of the carousel.

To facilitate inspection, the form can be manoeuvered manually or by a motor in the loading and inspection station so that it is orientated about its axis by the operator in specified and/or preferred angular positions.

At the station for discharging the treated garments, the form can be positioned angularly to present the product to a discharge apparatus. The discharge station is preferably located close to the loading station, to enable said operator to check that it is operating correctly.

Preferably, the form and/or at least one of the half-shells of the setting chamber is movable at the setting station in a direction orthogonal to the radial plane of movement of the form, to achieve the joining the two half-shells together to form the setting chamber surrounding the form, and for opening the chamber. One of the half-shells comprises a projection capable of moving the form in said orthogonal direction, to enclose it in the setting chamber by securing its base against the edge of the other half-shell, by overcoming the force of an opposing spring.

In a different embodiment of the invention, said guide means for the radial movement of each form comprise an articulated quadrilateral extending in a radial plane with respect to the carousel. Two opposite sides of the quadrilateral, namely the lower and upper side, are fitted respectively to the carousel and to said support of the form, in such a way that the support and the form can be moved and if necessary rotated in the plane of the form, for example in order to extract them radially from the carousel to present them between the half-shells of a setting chamber. For the movement of the quadrilateral, one of its sides, or an extension thereof, is coupled mechanically to said servo mechanisms for the radical movement of the forms. The articulated quadrilateral may also be a parallelogram, for moving the form radially without angularly changing its configuration in the corresponding radial plane in which it lies.

The equipment for the inspection and setting of knitted garments such as bodies, undershirts or similar, may comprise forms having lateral extensions on which the shoulder straps of the garment can be hooked, and, at a discharge station, a device for automatically removing the garments from the forms. This device comprises, in this case, a first moving element which carries two mechanical fingers operated by an actuator and capable of moving apart the shoulder straps of each body to detach them from said lateral hooking extensions of the form. This device also comprises a second moving element with lateral pressers for the garment on the sides of the form, which can be operated by means of a corresponding actuator, and an upper clamp capable of disengaging the part of the knitted garment opposite the shoulder straps from the form. Said first and second moving elements are integral with a carriage which runs on a vertical guide in synchronization with the movement of said upper clamp, to facilitate the disengagement of the body from the form.

In another embodiment of the invention, each of said forms comprises two elements extending in corresponding planes parallel to a radial plane of the carousel and close to it, these planes being juxtaposed with a certain distance between them so that they can receive respective legs of a pantyhose. This pair of elements is fixed to a support for the radial movement of the forms. A device for the automatic loading of the pantyhose onto said forms may be provided in proximity to the carousel. Additionally, blocks which reduce the internal volume of the chamber may be fixed within the setting chamber to enable this volume to be adapted to the dimensions of the forms in such a way as to limit the volume of steam supplied for each knitted garment.

In a further embodiment of the invention, the equipment comprises, at least at one station for transferring the forms and their support, a system capable of receiving and supporting a predetermined number of forms, to provide a holding area for them and to permit the execution of any necessary supplementary operations on the knitted garments fitted on the forms, including the loading of the garments onto the forms and their discharge from them. Said system may comprise, near to said first carousel, a second carousel rotating in steps and capable of receiving from the first carousel, by the use of transfer means, the moving supports complete with the corresponding forms and the treated garments. The second carousel may feed a station for discharging said garments from the forms and a subsequent station for transferring from the second carousel to the first, by further transfer means, the supports and the forms freed from the garments. The second carousel therefore acts as a buffer and a support for the forms for the execution of any necessary further operations on said garments. Said means of transferring the supports with the forms from one carousel to the other may comprise at least one orientating device capable of rotating the supports by means of an actuator through an appropriate angle about a vertical axis, to align the slidable support of the forms radially with respect to the carousel from which it is taken or to which it is to be transferred, and to allow said support with the corresponding form to be removed from the carousel or inserted into the carousel. This actuator may be disengageable to allow the free angular orientation of the form for manual loading and inspection of the knitted garment on the form. Additionally, on the second carousel, the forms may be rotatable about their own axes and spaced angularly to allow an angular rotation of 360°, thus enabling the knitted garments to be loaded on the forms, discharged from them, or inspected on them. It is also possible to provide a loading or discharge device interacting with a corresponding station of a carousel into which a support with the corresponding form is temporarily transferred by means of one of said servo mechanisms for the radial movement of the forms, to allow the knitted garment to be loaded onto the form or discharged from it. Said system may also comprise at least one belt conveyor capable of transferring to a carousel, or of receiving from a carousel, at a transfer station, the supports with the corresponding forms, to allow the garments to be loaded or discharged simultaneously by more than one operator.

The invention will be more clearly understood from the description and the attached drawing, which shows a non-restrictive example of the invention. In the drawing, FIG. 1 is a plan view of a piece of equipment according to the invention;

FIGS. 11 and 12 are side views, in partial section according to the arrows XI—XI of FIG. 1, of a station for discharging the product from the equipment, each view showing a different step of the discharge operation;

Figure 1:
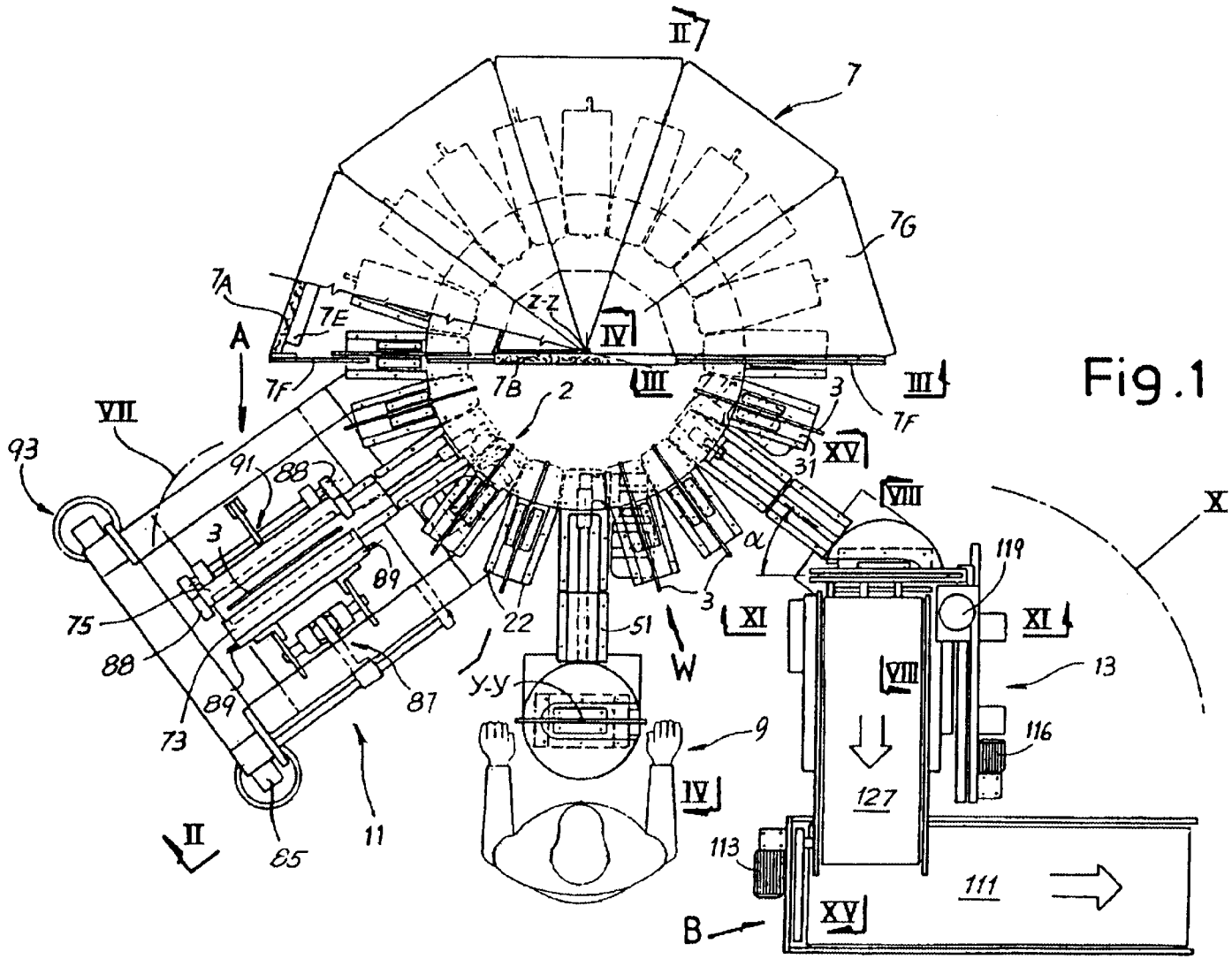
Figure 2:
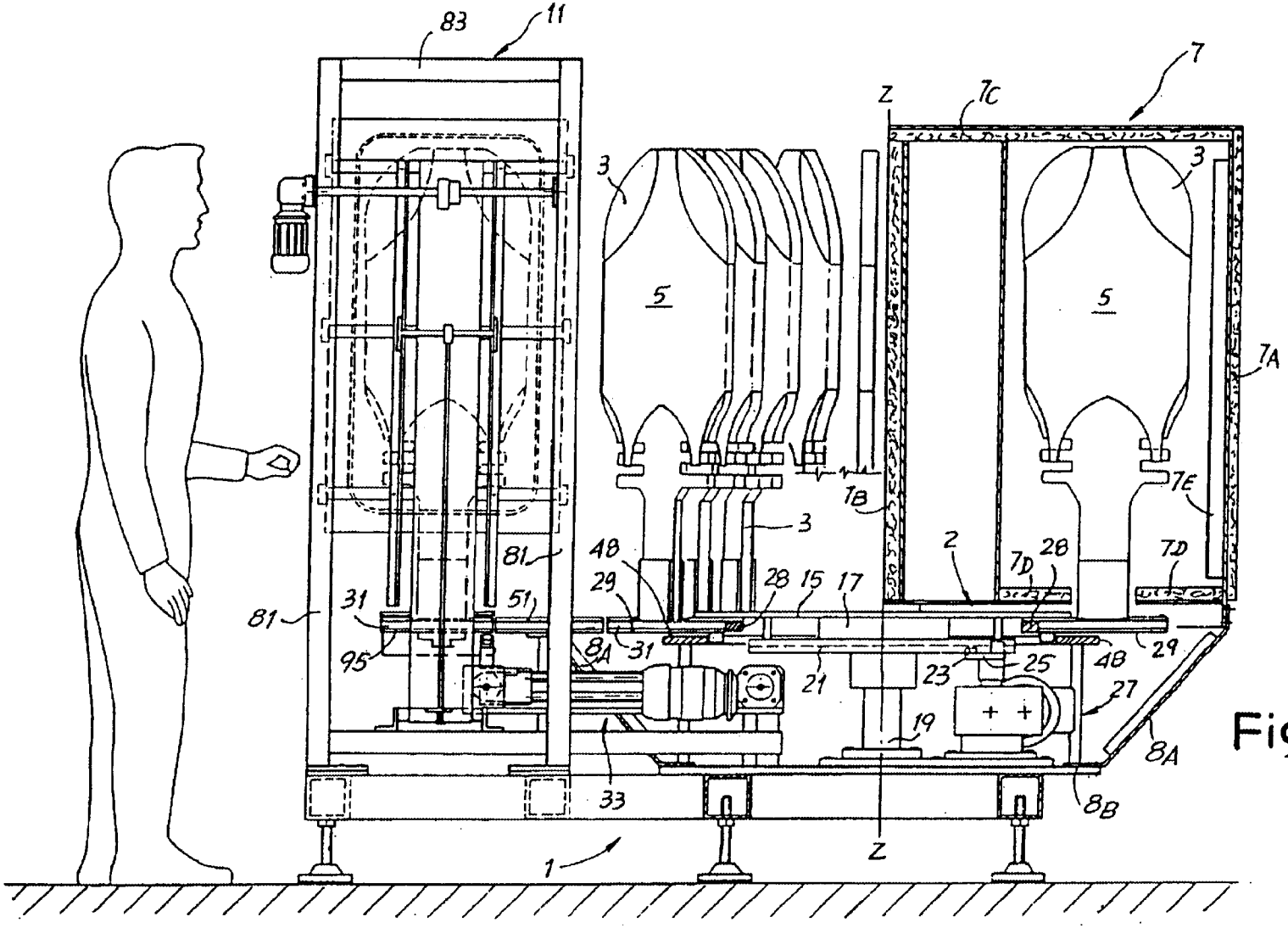
FIGS. 2 and 3 are side views of the equipment in cross section through the planes II—II and III—III respectively in FIG. 1.

The equipment comprises a robust tubular supporting frame 1 (FIG. 2) to which are fitted a carousel 2 (see also FIG. 1) rotating with an intermittent motion about a vertical axis Z-Z. The carousel carries on its periphery a plurality of flat forms 3 which are arranged in planes which are radial with respect to the axis of rotation Z-Z of the carousel, and are shaped in such a way that each form keeps a respective knitted garment 5 stretched and under tension during the treatment. A tunnel oven 7 formed by insulating side walls 7A, 7B, an insulating top wall 7C and an insulating bottom wall 7D, the last of which has a median channel permitting the passage of the lower parts of the forms, is located on the path of the forms. These walls are placed adjacent to the path followed by the forms when the carousel rotates, and the tunnel extends over approximately half of the circumferential path of the forms 3 of the carousel and is fixed to the frame 1 by means of inclined walls 8A and a plate 8B (FIG. 2). Diaphragms 7F (see also FIG. 3) shaped to match the perimeters of the forms, with a slight clearance with respect to these perimeters, are fitted to the entry and exit apertures of the tunnel. These diaphragms are located at a station where the forms stop in the course of the intermittent motion of the carousel, so that the entry and exit apertures of the tunnel are virtually blocked by the forms themselves, thus considerably reducing heat loss through the apertures. Within the tunnel 7, hot air generators 7E are arranged along the walls to dry the knitted garments in the stretched shape. In practice, the tunnel, in plan view, consists of four angular sectors 7G (FIG. 1), the angular width of each of these corresponding to two angular steps of the forms, in such a way that the length of the tunnel can easily be reduced to install any other necessary operating stations around the carousel, for example those for labeling or marking the garments, or other.

The equipment also comprises a station 9 for the manual loading of the knitted garment onto a form 3, in which station the operator also inspects the garment by rotating the form so that he can observe the garment from both of its sides; a steam-treatment station 11 for setting the garments stretched on the corresponding forms; and a station 13 for the discharge of the treated garments.

The carousel 2 comprises a circular plate 15 (see also FIG. 4) carried by a hub 17 rotatable about a vertical shaft 19 fixed to the frame 1 of the equipment. A ring wheel 21 shaped externally so that it forms, with a roller 23 carried on the end of a rotating arm 25, a known mechanism of the "Maltese Cross" type, is fitted under the plate 15 so that the carousel can be rotated intermittently by means of a geared motor 27. Segments 29 of radial guides, each capable of carrying a sliding support 31 integral with a corresponding form 3, are fixed on the periphery of the carousel at regular intervals.

At each of said loading station 9, setting station 11 and discharge station 13, corresponding units 33 (FIG. 4) for moving the forms radially to remove them from the carousel and to bring them into the operating position of each station, and to re-insert them into the carousel in the corresponding guides 29 after the completion of the processing, are fitted to the frame 1; clearly, these movements are carried out in the pauses between one movement of the carousel and the next. A unit 33 comprises a geared motor 35 on whose output shaft is keyed a pulley for a toothed belt transmission 37, the belt extending between said pulley and a return pulley 39 located near the corresponding operating station. A sliding piece 41 is fixed to one point of said belt, is slidable on guides parallel to the runs of the belt 37, and carries a vertical bar 43 to whose upper end a U-shaped bracket 45 is fixed. The bracket 45 can become engaged with an idle roller 47 fitted on a pin which is integral with, and projects from the bottom of, the sliding support 31 of each form, when the form reaches the angular position corresponding to the station in question. To prevent the radial movement of the forms both during rotation, owing to centrifugal force, and during the stops, owing to unforeseen actions, two containment rings, concentric with the carousel 2, are provided, one ring 28 (FIG. 2) being fixed to the rotating plate 15 of the carousel, with its inner edge bearing on the slides 31, and one ring 48 being fitted by means of brackets to the base 1, with its outer edge bearing on the idle roller 47 of the support of the forms 3. In each of the angular positions in which the form has to be removed radially, the ring 48 has an interruption of sufficient width to allow the passage of the roller 47. Additionally, in an angular position accessible from the exterior, such as the position indicated by the arrow W in FIG. 1, the ring 48 has a block which is easily removable, to permit the removal and rapid replacement of the form located in this angular position, in order to change the garment for example.

Figure 4:
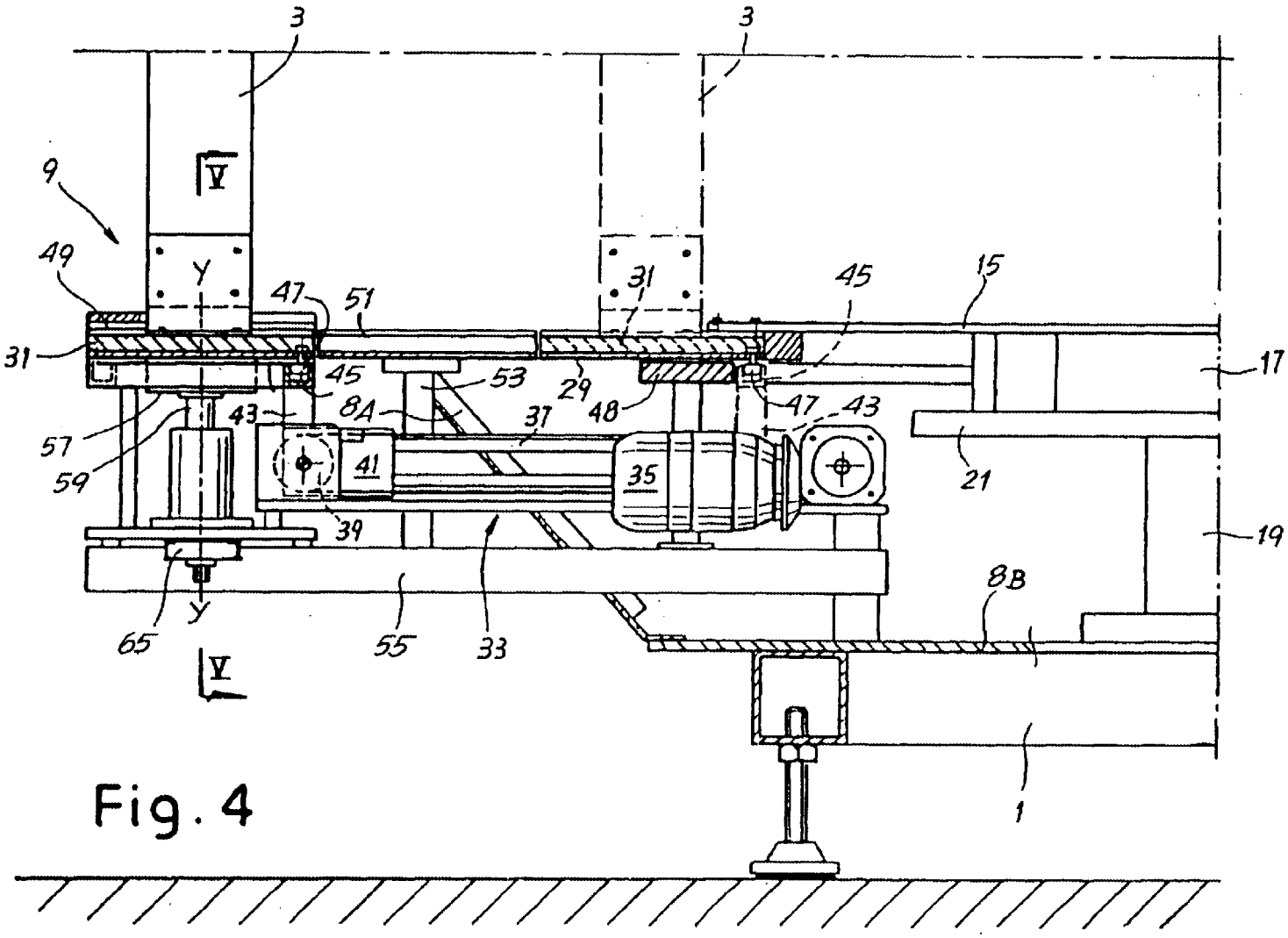
FIG. 4 is an enlarged partial side view of the equipment in cross section through the plane IV—IV in FIG. 1.

With this arrangement, the form 3 can be moved, by turning on motive power 35 of the unit 33, from a position where it is inserted into the radial guides 29 of the carousel 2 (as shown in broken lines in FIG. 4) to an operating position where it is inserted into guides 49 (see also FIGS. 5, 6) of the operating station, as shown in continuous lines in FIG. 4. The form is enabled to pass from the guides 29 of the carousel to the guides 49 of the operating station by a further guide section 51 interposed between said guides 29, 49 and fixed by means of a column 53 to the fixed structure 55, 1 of the machine.

At the station 9 for loading and inspecting the knitted garment, guides 49 for the sliding support 31 of a form 3 are fitted (FIGS. 4 and 5) to a U-shaped support 57 fixed to one end of a vertical shaft 59 supported by bearings 61, 63 which define an axis of rotation Y-Y. A pulley 65 connected by a toothed belt transmission 67 to a motor 69 is also keyed to the shaft 59. Thus, when the motor 69 is not switched on, the operator can rotate the form about the axis Y-Y to inspect both sides of the knitted garment fitted on it, and on completion of the inspection the form can again be orientated in a radial plane, manually or by means of said motor 69, so that it can be re-inserted into the carousel. During the rotation about the axis Y-Y, the idle roller 47 integral with the form passes from the bracket 45 of the radial movement unit to a circular track 71 concentric with the axis Y-Y, to keep the form radially immobile with respect to the axis Y-Y during the operation of loading and inspecting the garment.

Figure 7:
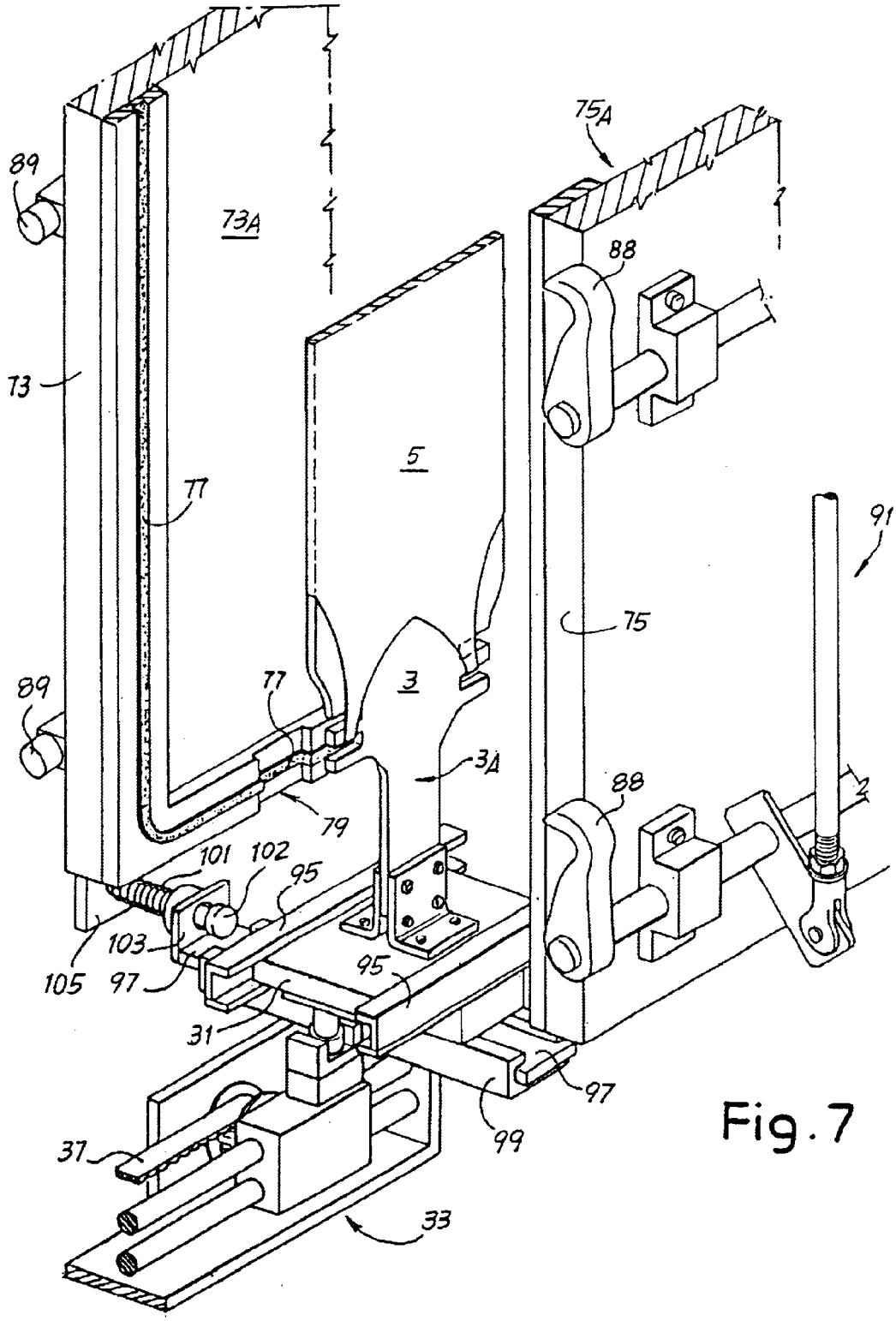
FIG. 7 is a perspective view in the direction of the arrow A of the detail VII of FIG. 1, enlarged.

The pressing station 11 comprises two half-shells 73, 75 (see FIGS. 1 and 7) of parallelepipedal shape, facing each other and capable of being brought together to form, by means of corresponding indentations 73A, 75A, a steam-tight chamber for a form 3, the tightness being provided by a frontal gasket 77 which follows the edge of each of said half-shells, including the part located in a recess 79 capable of containing a part 3A of the form to support the form, the gasket 77 of each half-shell in this recess 79 forming a seal with the side 3A of the form. One half-shell 75 is fixed to a cage of uprights 81 (FIG. 2) and cross-pieces 83 by means of brackets not shown in the drawing, the cage being fixed in turn to the frame 1 of the equipment. The other half-shell 73 is hinged to the cage and is driven by a geared motor 85 (FIG. 1) which, by means of a linkage 87, can move it up to or away from the half-shell 75. In the open configuration of the half-shells 73, 75 shown in FIG. 1, the radial movement unit 33 can remove from the carousel the form 3 which is facing the setting station 11, and insert it between said half-shells, as shown in FIG. 1. The half-shell 73 is then moved up to the half-shell 75 and held against it by means of hooks 88 (see also FIG. 7) pivoted on the half-shell 75, these hooks being engaged with pins 89 on the half-shell 73 by means of a linkage 91 and a geared motor 93. Thus the pressing chamber is securely closed and steam can be injected under pressure to press the garment 5 on the form 3. In the position with the form 3 inserted between the half-shells, the sliding support 31 of the form is inserted in a portion of the radial guide 95 (FIG. 7) which is fixed to a sliding piece 97 slidable within a guide 99 which is orthogonal to the plane of the form. The sliding piece 97 is pushed by a compression spring 101 guided by a pin 102 which is slidable in a bracket 103 projecting upwardly from the sliding piece 97 when a projection 105 integral with the half-shell 73 bears, in the closing movement of the half-shells, on the free end of the pin 102. Thus, when the movement which brings the half-shell 73 up to the half-shell 75 takes place, the projection 105 moves the form 3 to enclose it between the half-shells 73, 75, overcoming the action of the spring 101. When the setting chamber is re-opened, with the movement of the half-shells 73, 75 away from each other, the spring 101 brings the guide 95 with the form 3 back into alignment with the corresponding radial guide of the carousel, to allow the movement unit 33 to return the form to the carousel to continue the treatment process.

Figure 8:
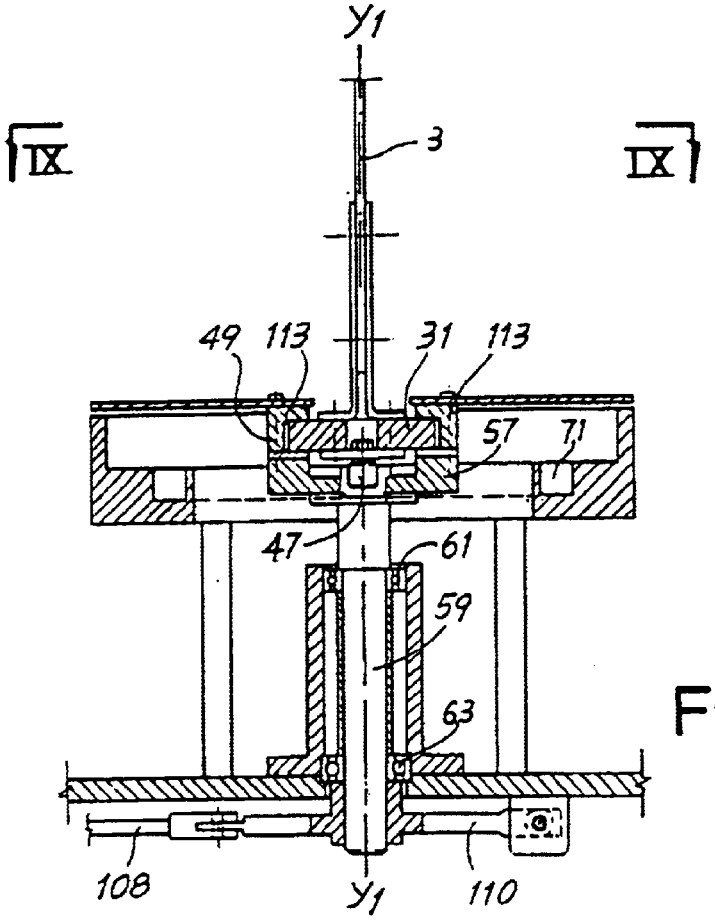
FIG. 8 is a view of the device for rotating the form at the discharge station, in cross section through the plane VIII—VIII in FIG. 1.
Figure 9:
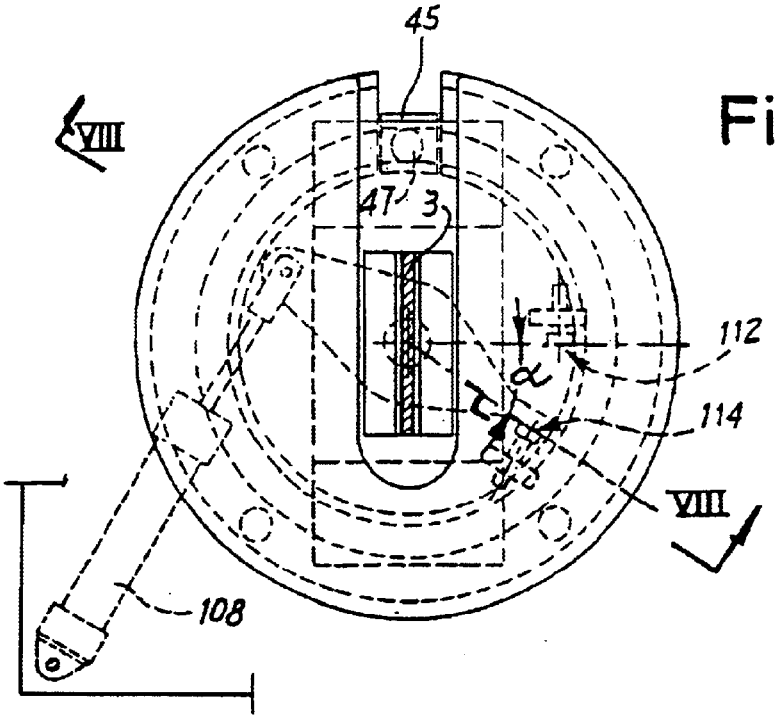
FIG. 9 is a plan view of said rotation device in cross section through the plane VIII—VIII in FIG. 8.

The discharge station 13 comprises a device 107 (FIG. 10) for disengaging the knitted garment from the form 3 and a device 109 capable of spreading one garment 5 at a time on a conveyor belt 111, overlapping them in the desired quantity. The form 3 is presented to the disengaging device 107 with radial removal from the carousel by means of a radial movement device identical to the device 33 described above and with a partial rotation about its own axis of a device for angular rotation of the form about a vertical axis; this rotation device is shown in FIGS. 8 and 9, and is identical to that described for the loading station 9 (the same references are used for identical elements), but is driven not by a motor, but by a jack 108 which, by means of a lever 110 integral with the form 3, can be used to rotate the form through an angle $\alpha$ (FIGS. 1 and 9) pre-set by means of adjustable stops 112, 114. The rotation device receives the sliding support 31 of one form from the radial removal device 33 in a guide portion 113 which is pivoted on the vertical shaft 59 of the rotation device and causes the form 3 to rotate about the axis Y1-Y1 of this shaft through said angle $\alpha$ into a convenient position for the disengagement of the garment, as will be described subsequently.

Figure 3:
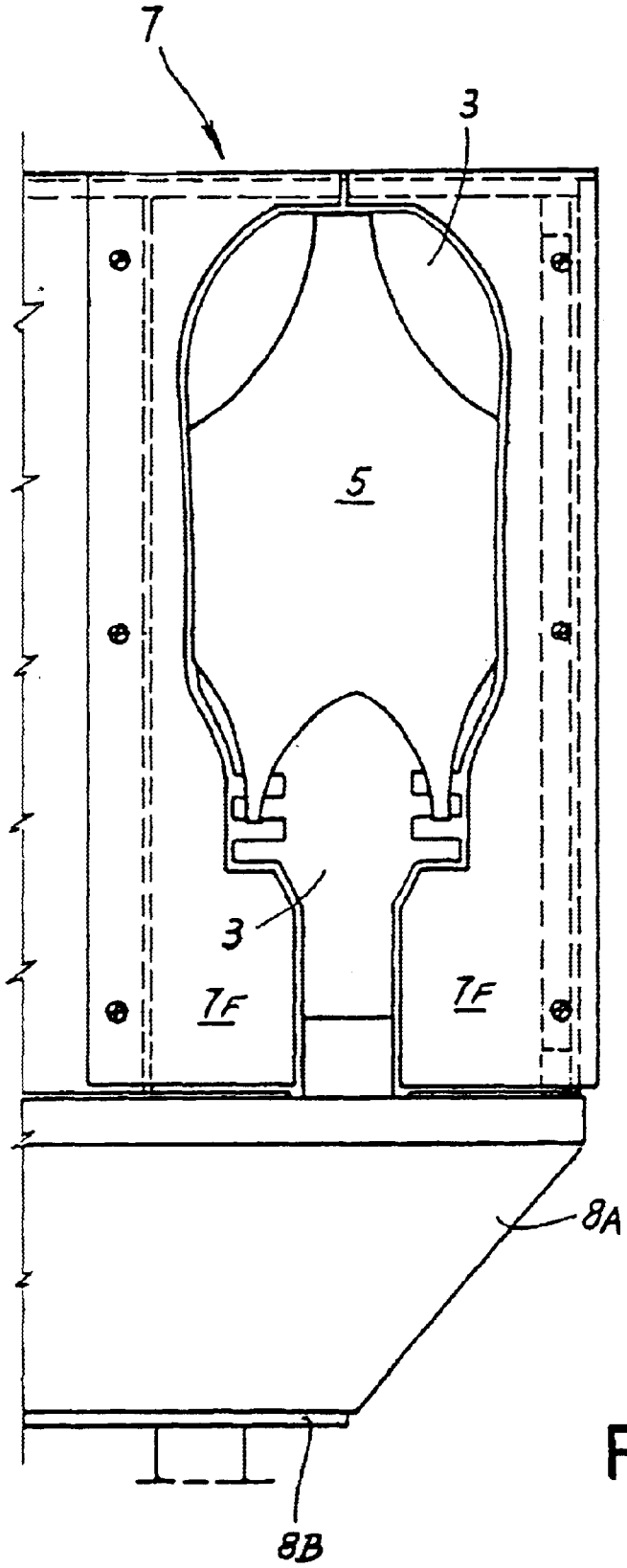

In FIG. 3, the garment 5 shown is garment known as a "body" placed with the shoulder straps downward and hooked on corresponding extensions 3B of the form; a plurality of extensions 3B are provided on the form and located at different heights to receive the shoulder straps of garments of different sizes.

Figure 10:
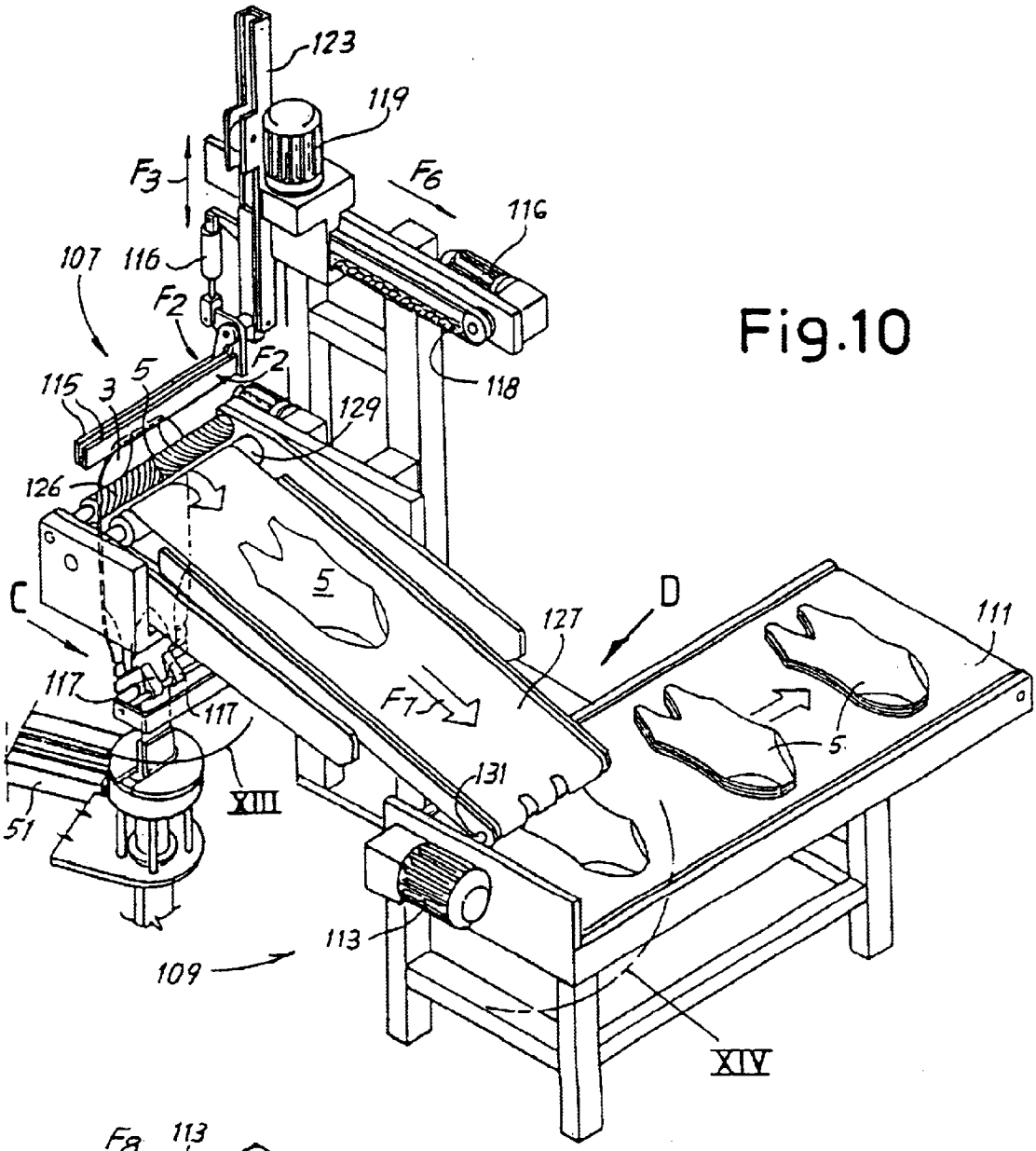
FIG. 10 is a perspective view in the direction of the arrow B in the detail X of FIG. 1.
Figure 14:
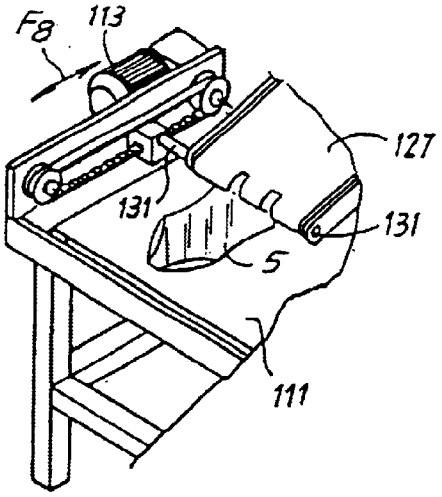
FIG. 14 is a perspective view in the direction of the arrow D in the detail XIV of FIG. 10.
Figure 13:
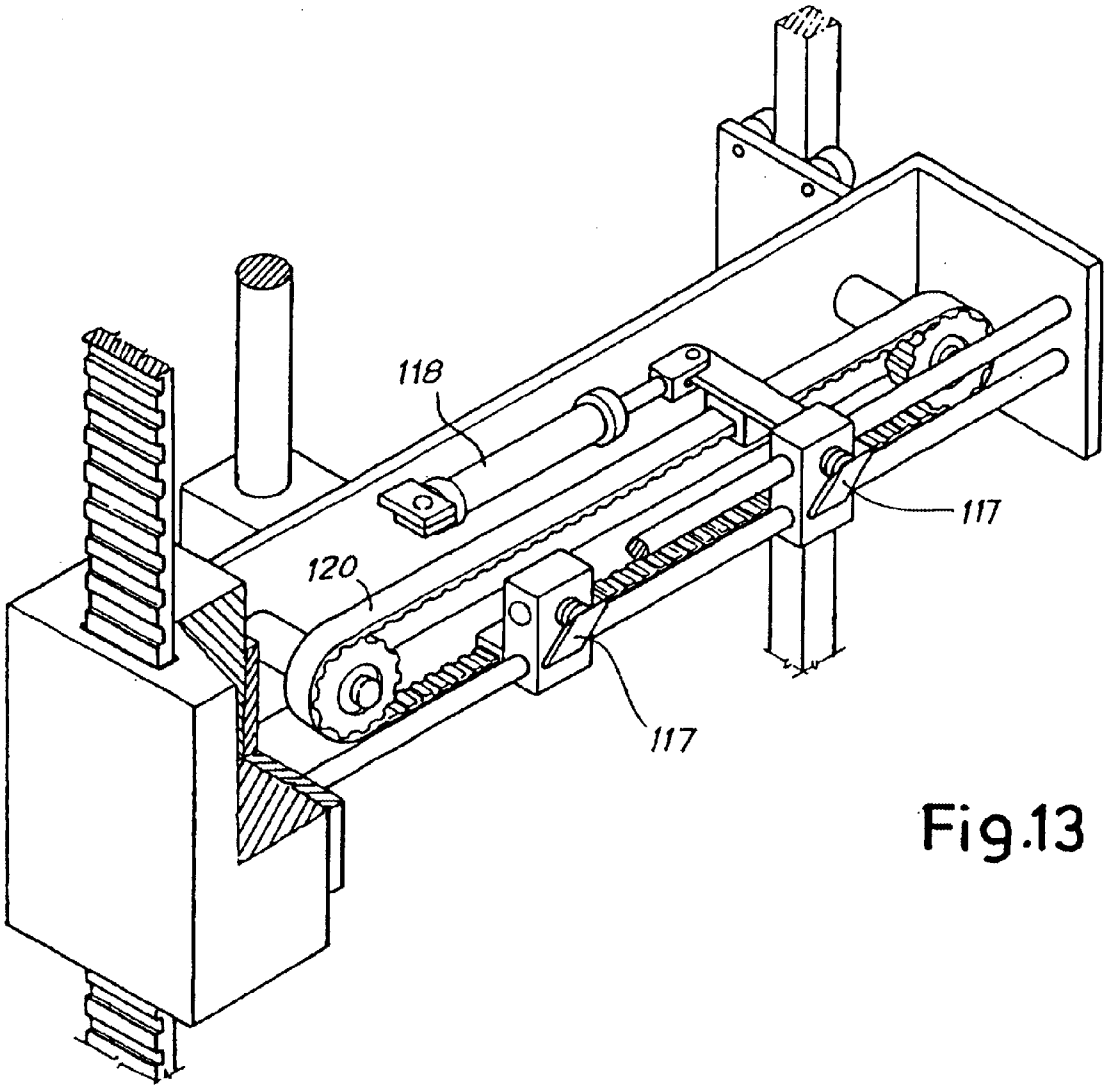
FIG. 13 is a perspective view in the direction of the arrow C in the detail XIII of FIG. 10.

The disengagement device 107 (FIG. 10) comprises a pair of clamping arms 115 which can bear in the direction of the arrows F2 (FIG. 15) from opposite sides of the flat form 3 on the crotch of the garment 5 to grip it and stretch it upward by a movement in the direction of the arrow F3. The device also comprises two fingers 117 which can slide with their ends in contact with the surface of the form 3 at the positions of the extensions 3B in the direction of the arrows F4 (FIG. 11), moving away from each other to unhook the shoulder straps of the garment 5 from said extensions 3B. The fingers 117 are then raised in the direction of the arrow F5 (FIG. 12), thus interacting with the clamp 115 to disengage the garment 5 from the form 3. The upward movements of the clamp 115 and the fingers 117 are provided by means of corresponding geared motors 119, 121 and driving belts 123, 125, while the transverse movement of the fingers 117 is provided by means of a jack 118 (FIG. 13) which drives a conveyor belt 120 extending between two pulleys 122, one of the fingers 117 being fixed to the upper run of the belt and the other being fixed to the lower run. When the garment 5 has been disengaged from the form 3, the clamps 115 are made to slide horizontally in the direction of the arrow F6 (FIG. 15) by means of a geared motor 116 and a belt conveyor 118, thus supporting and spreading out the garment 5 initially on a spreading roller 126 and then on the downward run of a conveyor belt 127 which is orthogonal—in plan view—to the conveyor belt 111 and whose upper run extends between an upper roller 129 and a lower roller 131 located above the belt 111. The spreading roller 126 has a surface grooved to form a left-hand spiral over half of its length and a right-hand spiral over the other half, as shown in FIG. 10, and rotates in the direction of the arrow F8 (FIG. 15) in such a way as to oppose a frictional resistance to the garment 5 and spread out any wrinkles in it. The axis of the lower roller 131 can be made to move horizontally over approximately the whole width of the belt 11 by means of a geared motor 133 and a belt conveyor 135. The garment 5 is transferred in the spread state from the belt 127 to the belt 111 as described below.

Figure 15:
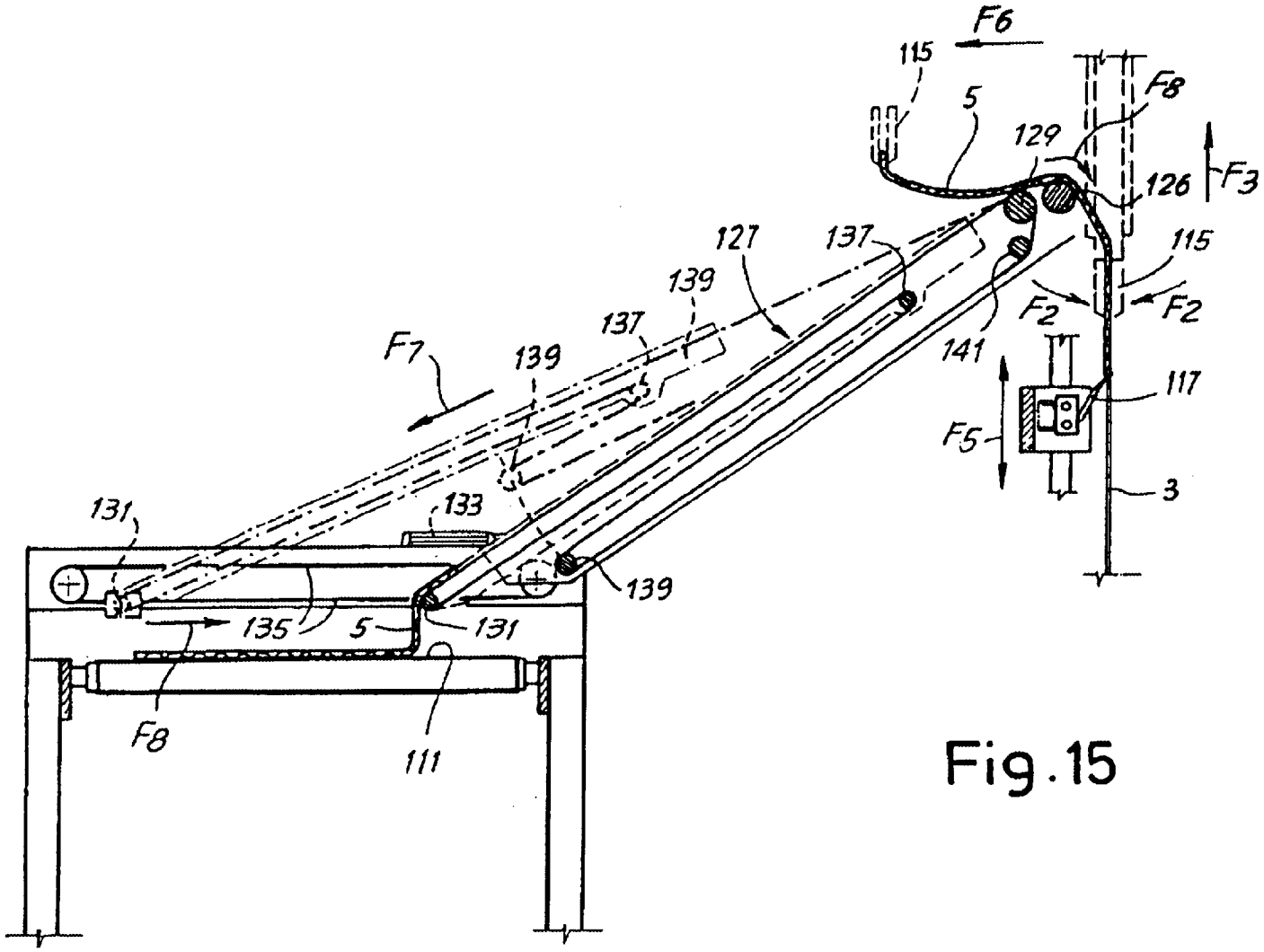
FIG. 15 is a side view of the discharge station in cross section through the plane XV—XV in FIG. 1.

With reference to FIG. 15, according to a known arrangement, the belt 127 extends not only between the aforesaid rollers 129 and 131 but also between another three rollers 137, 139, 141 with a path having partially superimposed and parallel portions as shown in FIG. 15. The axes of the rollers 129, 141, 139 are fixed together by means of a first pair of lateral shoulders, not shown in the drawing, hinged about the axis 129 to the fixed structure of the machine. The axes of the rollers 131, 139, 137 are fixed to a second pair of lateral shoulders 139 which are mounted slidably parallel to the direction of the portion of belt 127 extending between the rollers 129 and 131. With this arrangement, starting from a position of the belt as shown in broken lines in FIG. 15, if the rotation of the roller 129 is prevented and the roller 131 is moved in the direction of the arrow F8 the belt 127 lays the garment 5—which has previously been made to advance near to the roller 131—on the underlying belt 111 without the formation of folds or wrinkles, since this laying down takes place without movement of the garment 5 relative to the belts 127, 111. When the garment 5 has been laid down, the roller 131 is returned to the position shown in broken lines in FIG. 15 to lay down another garment on top of the preceding one, and the operation is repeated in such a way that a predetermined number of garments is stacked. After this, the belt 111 is again made to advance by one step so that a new stack of garments can be started, as shown in FIG. 10.

Figure 16:
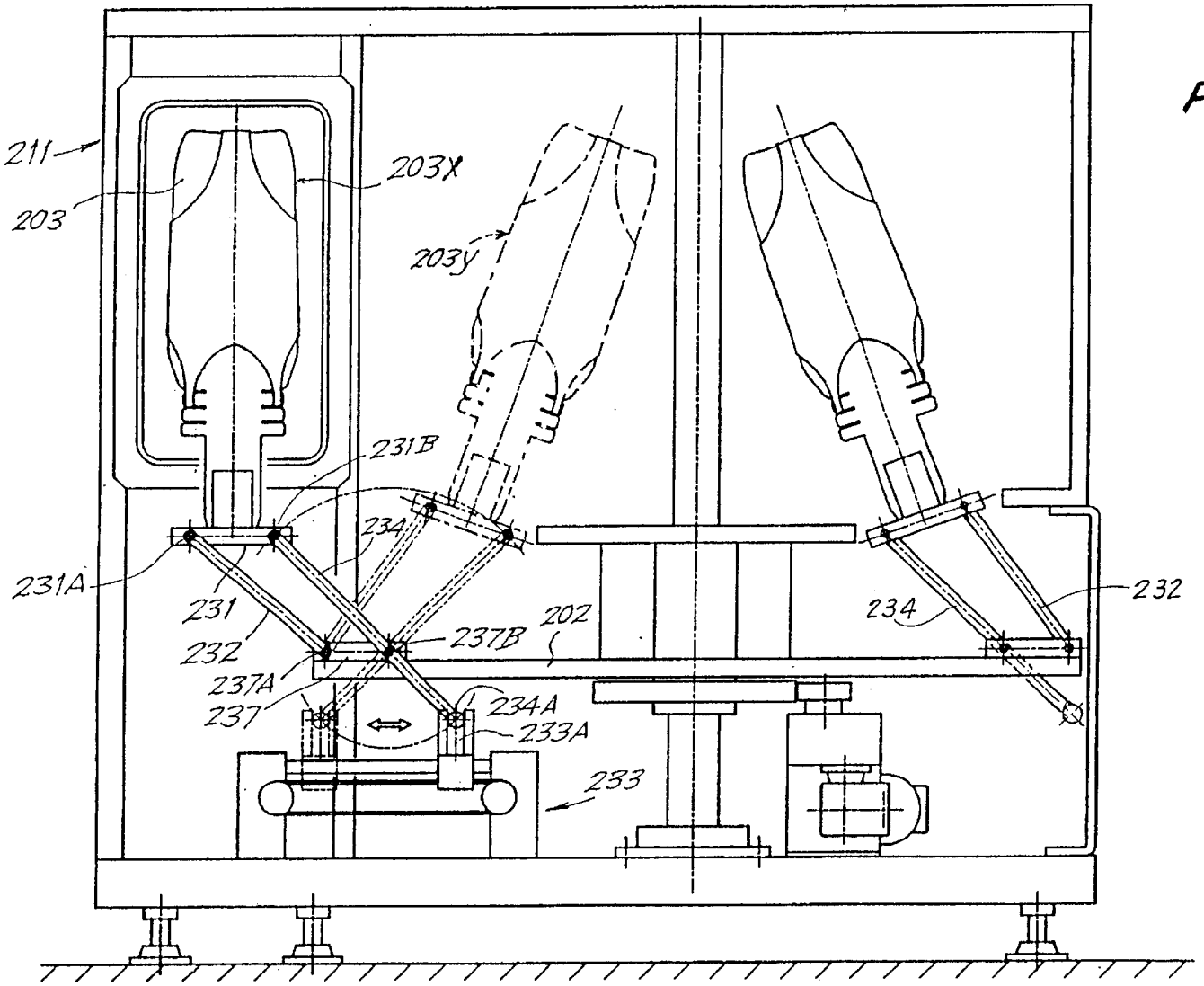
FIGS. 16 and 17 show, in each case, a cross section of a piece of equipment according to a different embodiment of the invention.

With reference to FIG. 16, the support 231 of each form 203 is pivoted by means of corresponding pins 231A, 231B on one end of each of corresponding bars 232, 234 which, in turn, are pivoted by means of pins 237A, 237B on a block 237 integral with a carousel 202. The bars 232, 234, together with the support 231 and the block 237, form an articulated quadrilateral. The bar 234 is extended beyond the pin 237B and, at the opposite end from the pin 231B, has a pin 234A capable of sliding in a vertical guide 233A of a radial sliding unit 233 which is identical to and has the same functions as the units 33 in FIG. 2. Thus, when the motor of the unit 233 is switched on, the movement of the guide 233A causes the rotation of the bar 234 and the movement of the form 203 which can thus be made to change from a radially more outward vertical configuration 203X (shown in continuous lines in FIG. 16), for example for treatment in a setting chamber 211 outside the carousel (the chamber is shown in cross section with a radial plane), to an inclined configuration 203Y radially more inward with respect to the carousel (shown in broken lines) allowing the carousel to rotate between different angular positions.

Figure 17:
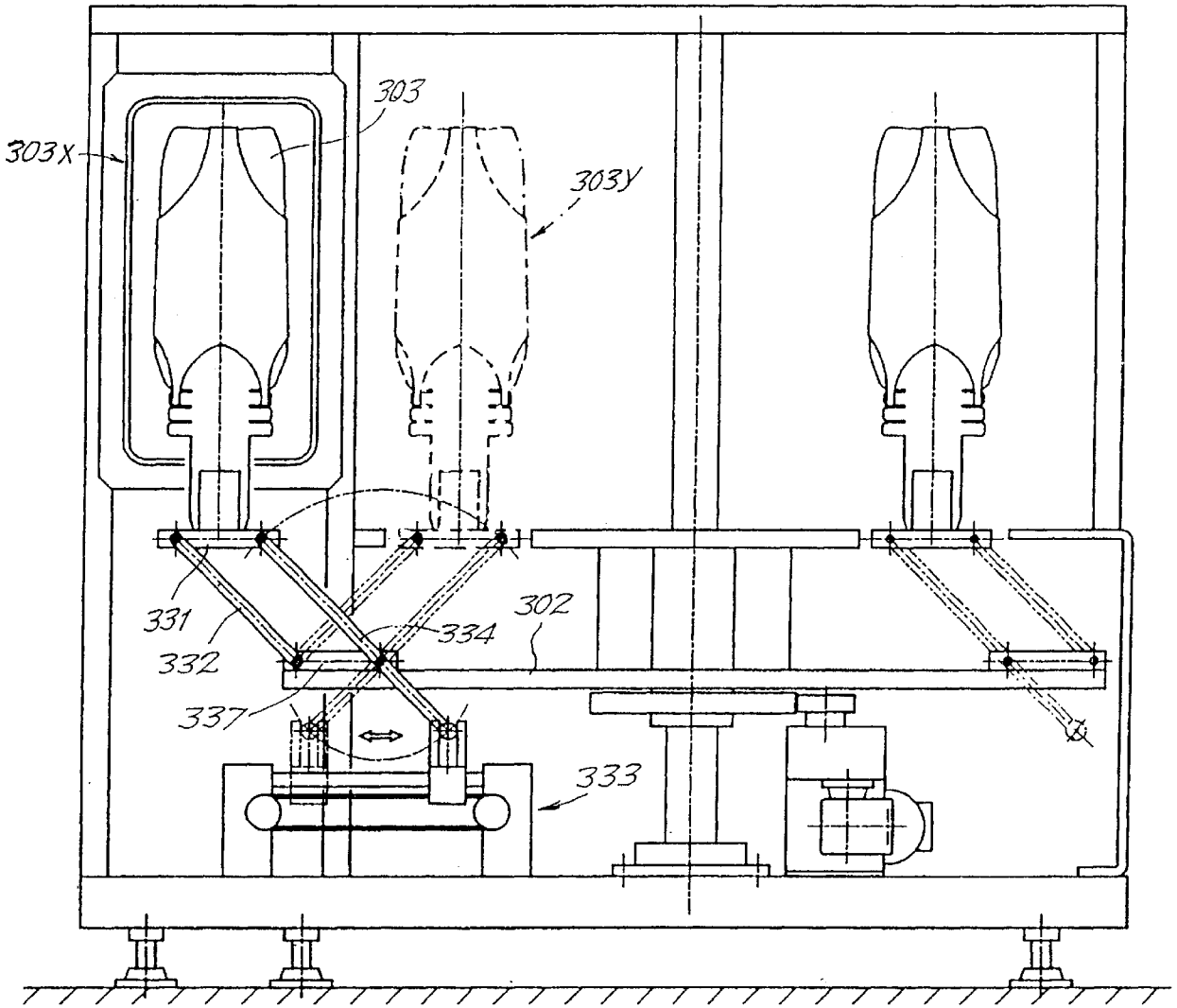

In an embodiment of the invention similar to the preceding one, the forms 303 (FIG. 17) are connected to the carousel 302 by means of an articulated parallelogram formed by bars 332, 334 and blocks 331, 337, in such a way that the forms can be moved, by the activation of the radial movement units 333, between an outer configuration 303X (shown in continuous lines) and an inner configuration 303Y (shown in broken lines), without the rotation of the form in the corresponding plane which is radial with respect to the carousel.

Figure 18:
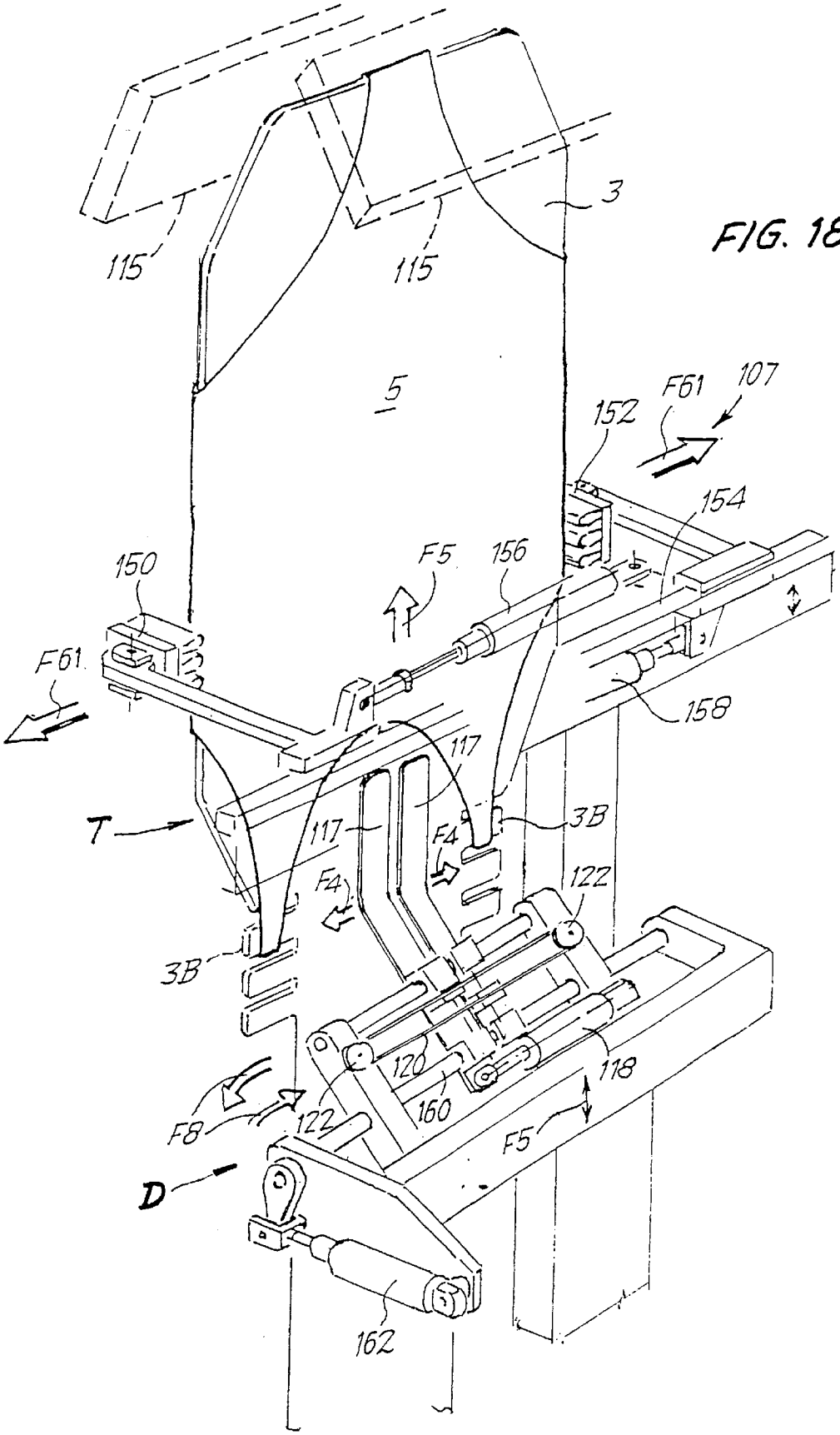
FIG. 18 is a perspective view of a device for discharging a body from the form.

FIG. 18 shows in detail the device 107 for removing a body 5 from the form 3, this device being very similar to that shown previously in FIG. 10, in which similar parts are indicated by the same references. The device comprises, in addition to the upper clamp 115 and the fingers 117 which were described previously in relation to FIGS. 10 to 12, a moving element T which has two pressers 150, 152 capable of bearing elastically on the sides of the form 3 with the interposition of the fabric of the body 5, or of moving away in the direction of the arrows F6. These pressers slide on a guide 154 under the action of corresponding jacks 156, 158. The fingers 117 are, in turn, carried by a moving element D comprising a guide bar 160 for the movement of the fingers 117 under the action of a jack 118 with the interposition of the belt 120 running round pulleys 122. The assembly of the bar 160 and the fingers 117 can be made to rotate in the direction of the arrows F8 by a jack 162, also forming part of the moving element D, to bring the fingers up to the form 3 or to move them away from it. The moving elements T and D are fitted to a common carriage, which is not shown in the figure and is capable of sliding vertically in the direction of the arrows F5. In operation, the clamp 115 is closed onto the crotch of the body, the fingers 117 are brought close to the form 3 by means of the jack 162, and the pressers 150 are pressed against the sides of the form 3 by means of the jacks 156, 158. The fingers 117 are then moved away from each other by means of the jack 118, and thus unhook the shoulder straps of the body from the extensions 3B of the form 3. This is followed by the raising in the direction F5 of the system formed by the moving elements T and D and the raising of the clamps 115, until the body is completely disengaged from the form 3.

Figure 19:
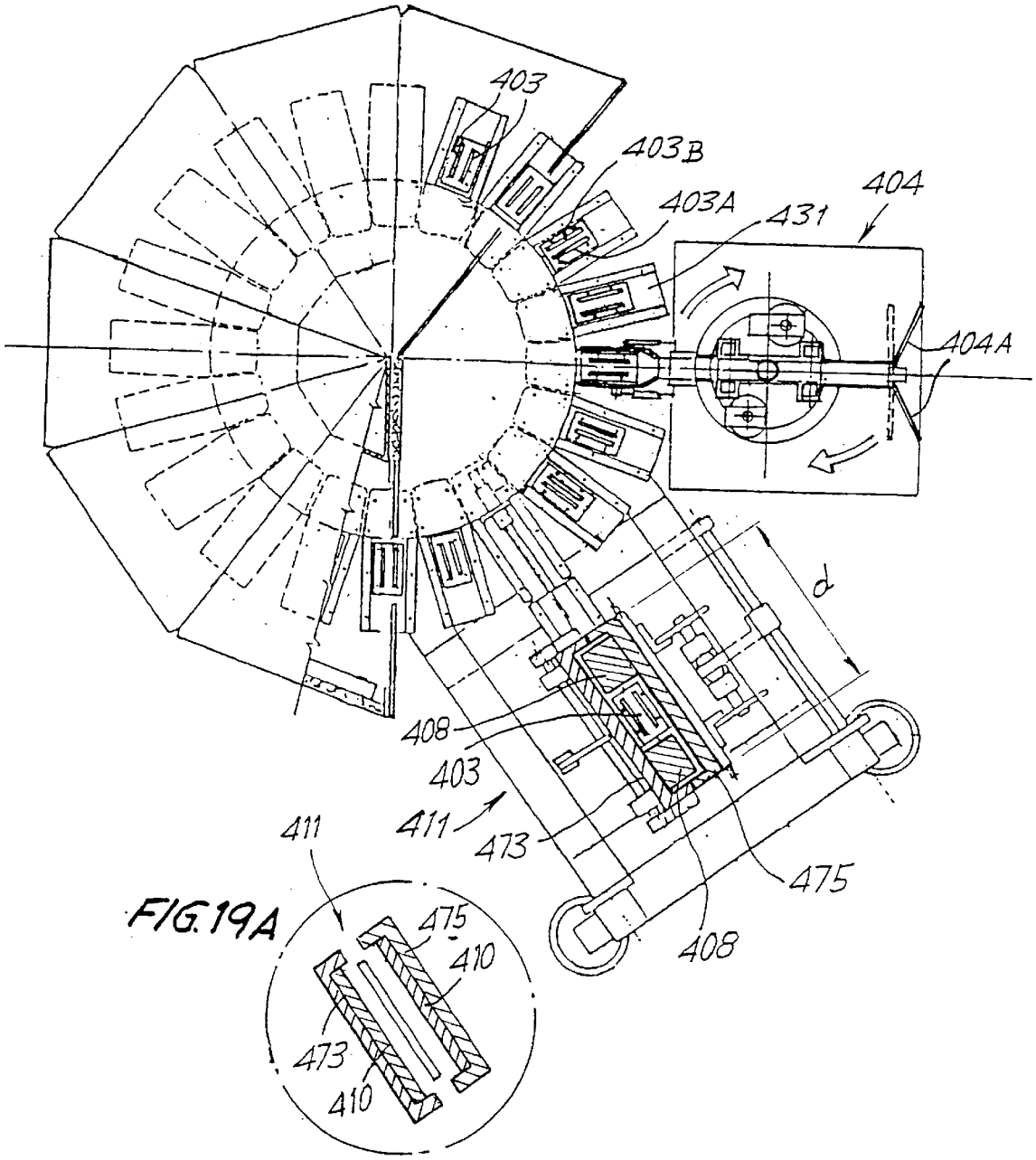
FIGS. 19 and 20 are, respectively, a plan view and a side view in partial section of another embodiment of the invention.
Figure 20:
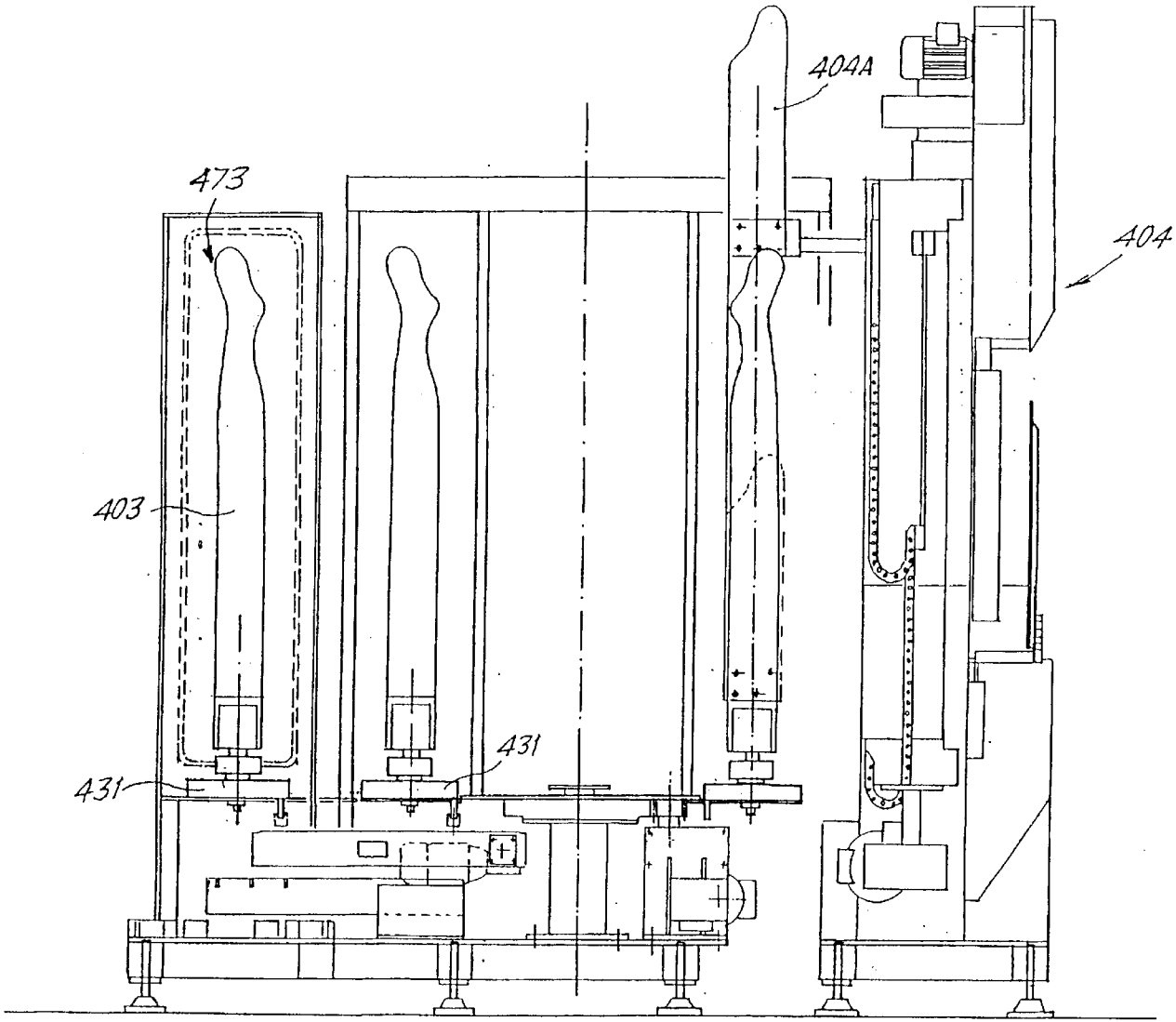

With reference to FIGS. 19 to 20, the equipment, which is similar to that shown in FIG. 1, comprises forms for pantyhose 403, each consisting of a pair of flat forms 403A, 403B fitted to a support 431 which is slidable radially with respect to the carousel. Each pair of pantyhose is loaded onto the corresponding form 403 by means of a loading device 404, of a known type, which is outside the carousel and is provided with an auxiliary form 404A which can be opened like a book for the inspection of the pantyhose by an operator 406. The forms 403 are transferred into the operating cycle of the equipment in the same way as the forms 3 in the case shown in FIG. 1. The setting chamber 411 has an internal volume sufficient to contain both legs of the form 403. Since the setting chamber can also be used with wider and thinner forms, for example those for knitted undergarments such as bodies or undershirts, and therefore has a corresponding internal width (d), provision is made for fitting filler blocks 408 to the half-shells 473, 475 of the chamber at the sides of the space reserved for the form 403, in order to reduce the volume of steam used in each setting cycle. For the same purpose, the detail in FIG. 19A shows the setting chamber 411 arranged for the setting of bodies or similar mounted on wide thin forms, with filler blocks 410 fitted to the half-shells 473, 475 and extending along their inner surface.

Figure 21:
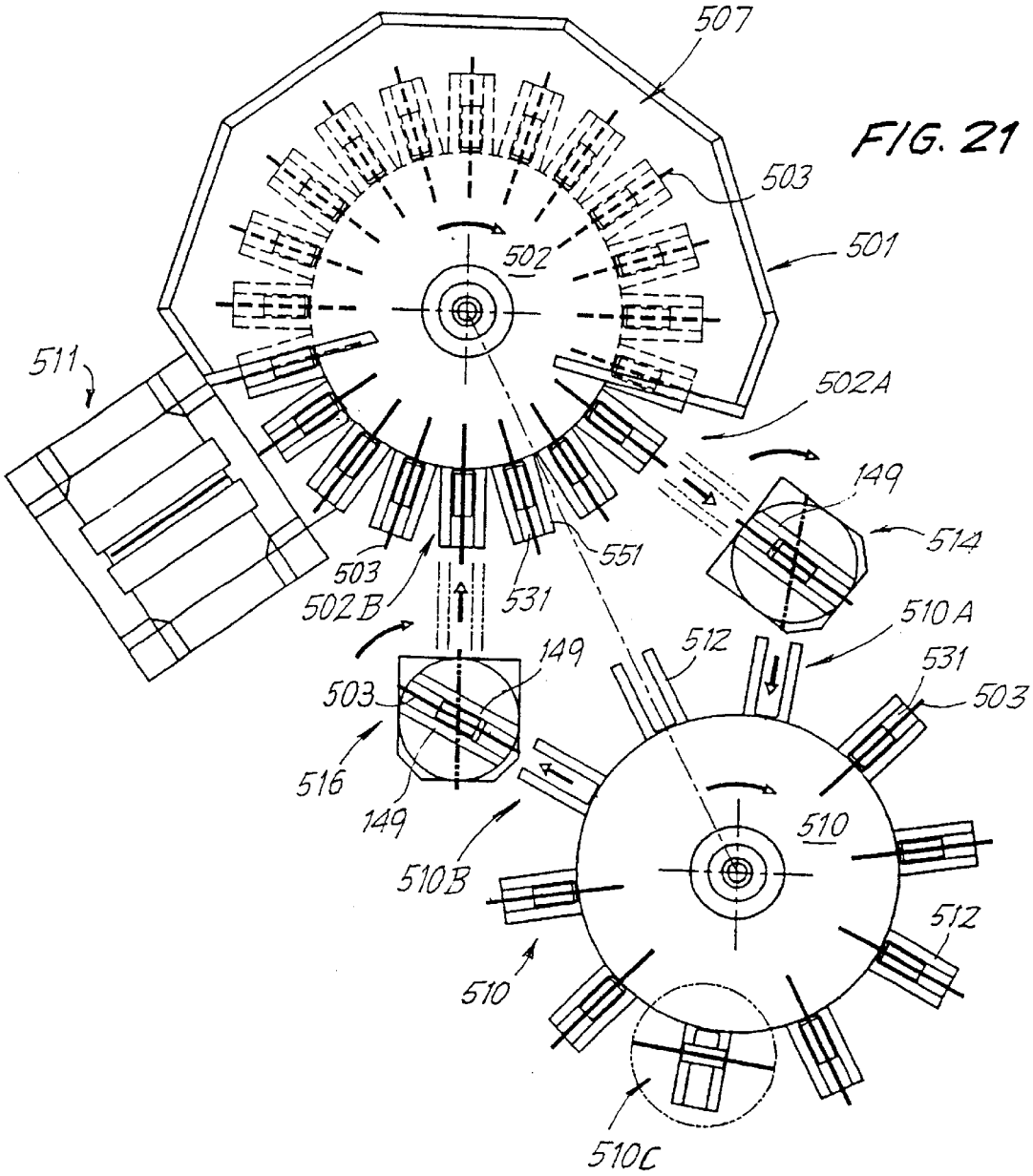
FIGS. 21 to 24 are corresponding plan views of other embodiments of the invention.

With reference to FIG. 21, the equipment comprises a system 501 with a carousel 502 for radial forms 503 placed angularly adjacent to each other, a setting chamber 511 and a drying oven 507 similar to the previously described similar elements shown in FIG. 1; the equipment also comprises a second carousel 510 on the periphery of which are fitted guides 512 similar to the guides 551 of the first carousel 502, each of said guides being capable of receiving a sliding support 531 with the corresponding form 503. The equipment also comprises two transfer devices 514, 516, of which the first 514 is located at a station 502A for removal from the first carousel and at a station 510A for feeding to the second carousel, and the second 516 is located at a station 510B for removal from the second carousel 510 and at a station 502B for feeding to the first carousel 502. These devices 514, 516 are similar to the rotation device shown in FIGS. 5 and 6, but have guides 149 passing through them and a rotation actuator (not shown in the drawing) capable of rotating said guides 149 to align them either with the guides 551 of the station 502A of the first carousel or with those 512 of the station 510A of the second carousel 510. At these said stations 502A, 502B; 510A, 510B, each carousel has devices for the radial movement of the forms (not shown in the drawing) which are similar to the devices 33 in FIG. 2, and are capable of transferring a form 503 with the corresponding support 531 from one carousel to the rotation device 514, 516 and, after said alignment rotation, from this device to the other carousel. These devices can also be used not only for transferring, but also for other operations, for example for loading a knitted garment on the form or disengaging it from the form, manually or by means of suitable devices, to start or terminate the treatment of the garment. For example (see FIG. 21), the garment may be loaded and inspected in the form which is found in the device 516, undergo the setting and drying cycle on the carousel 502, be transferred to the carousel 510 by the device 514, and finally be removed manually at a station 510C of the carousel 510 after having undergone any other necessary operations, such as labeling or any necessary completion of drying or other. Since adjacent forms on the carousel 510 can be spaced further apart than those on the carousel 502, the form can be rotated about its vertical axis at the station 510C and in general at all the stations of the carousel 510, for additional inspection of the garment mounted on it, or for other operations, such as loading the garment onto the form or removing the garment from it.

Figure 5:
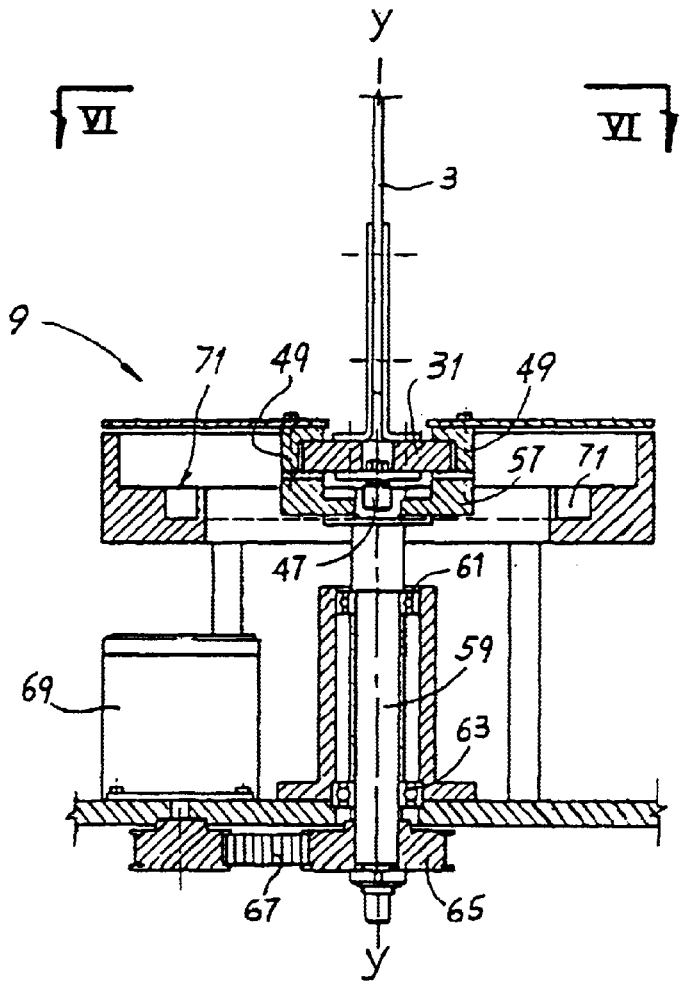
FIGS. 5 and 6 are, respectively, an enlarged side view and a partial plan view of the equipment in cross section through the plane V—V in FIG. 4 and the plane VI—VI in FIG. 5.
Figure 6:
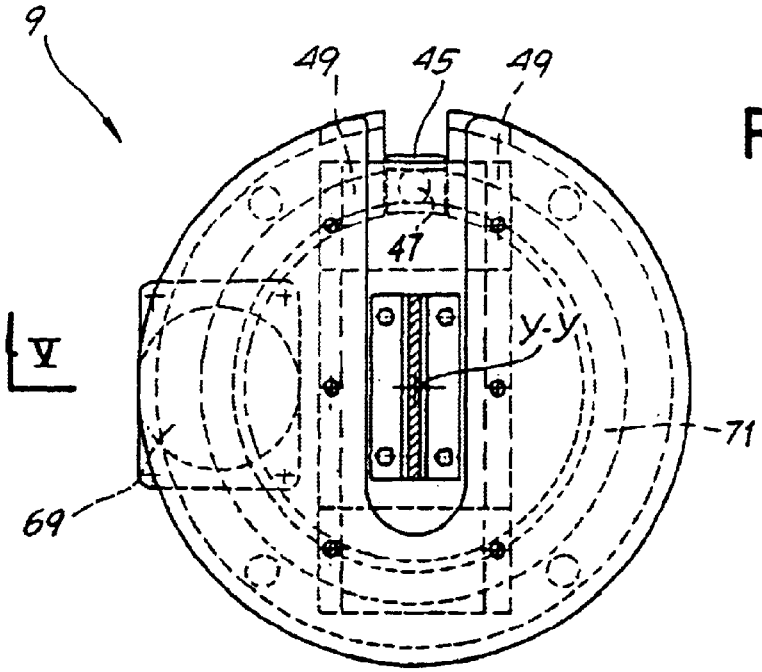
Figure 22:
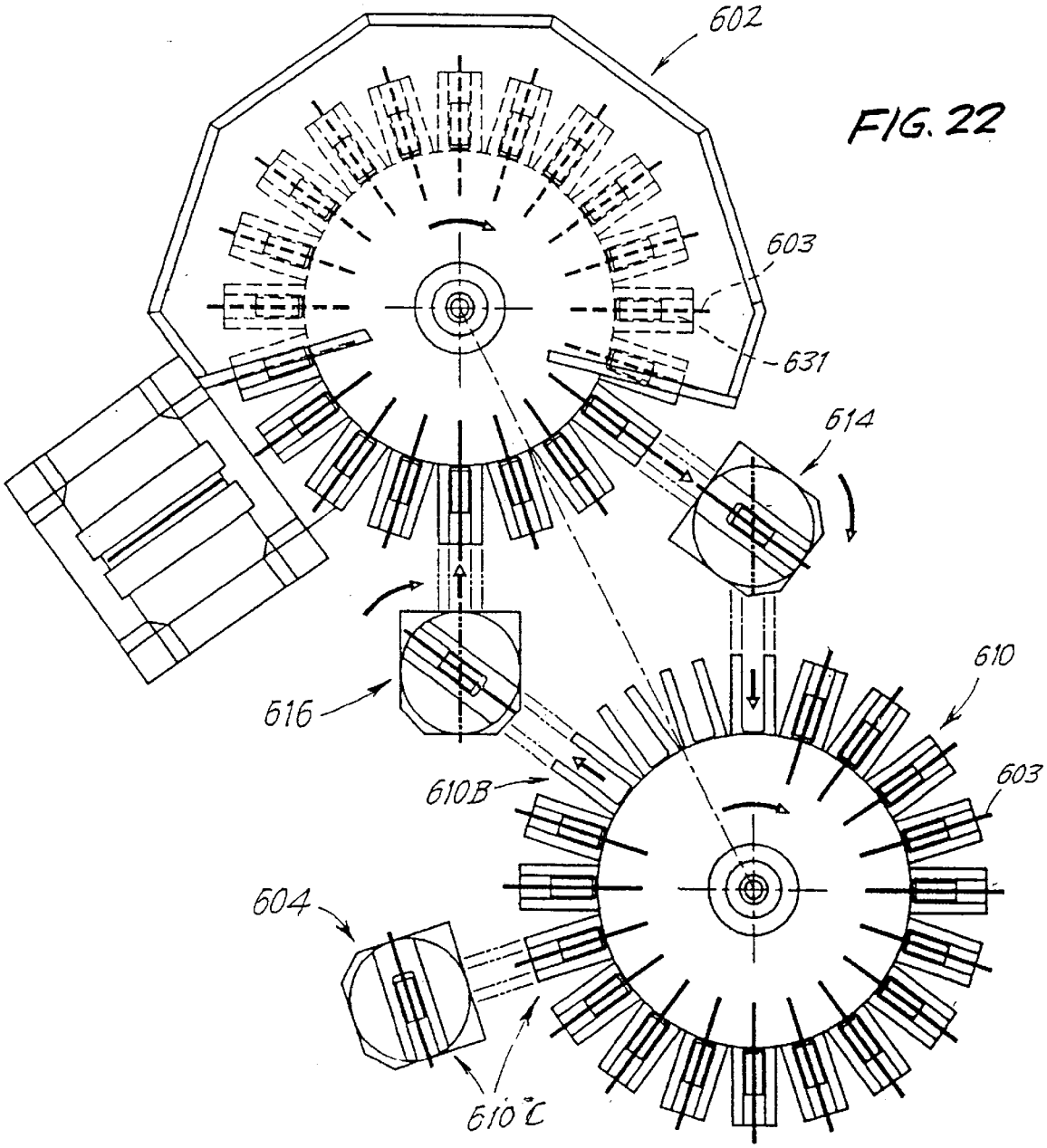

FIG. 22 shows an arrangement similar to that shown in FIG. 21, in which the second carousel 610 has a minimal angular interval between the forms 603, of the same order of magnitude as that between the forms in the first carousel 602. This arrangement is particularly suitable for heavy garments which require a longer drying time. A discharge station 610C, complete with a device for the radial movement of the forms (not shown in the drawing, and similar to the device 33 in FIG. 2) and a discharge device 604 outside the carousel, similar to the device shown in FIGS. 5 and 6, is provided for discharging the garment from the corresponding form. The garments may be loaded directly onto the device 616 for transferring the forms from the carousel 610 to the carousel 602.

Figure 23:
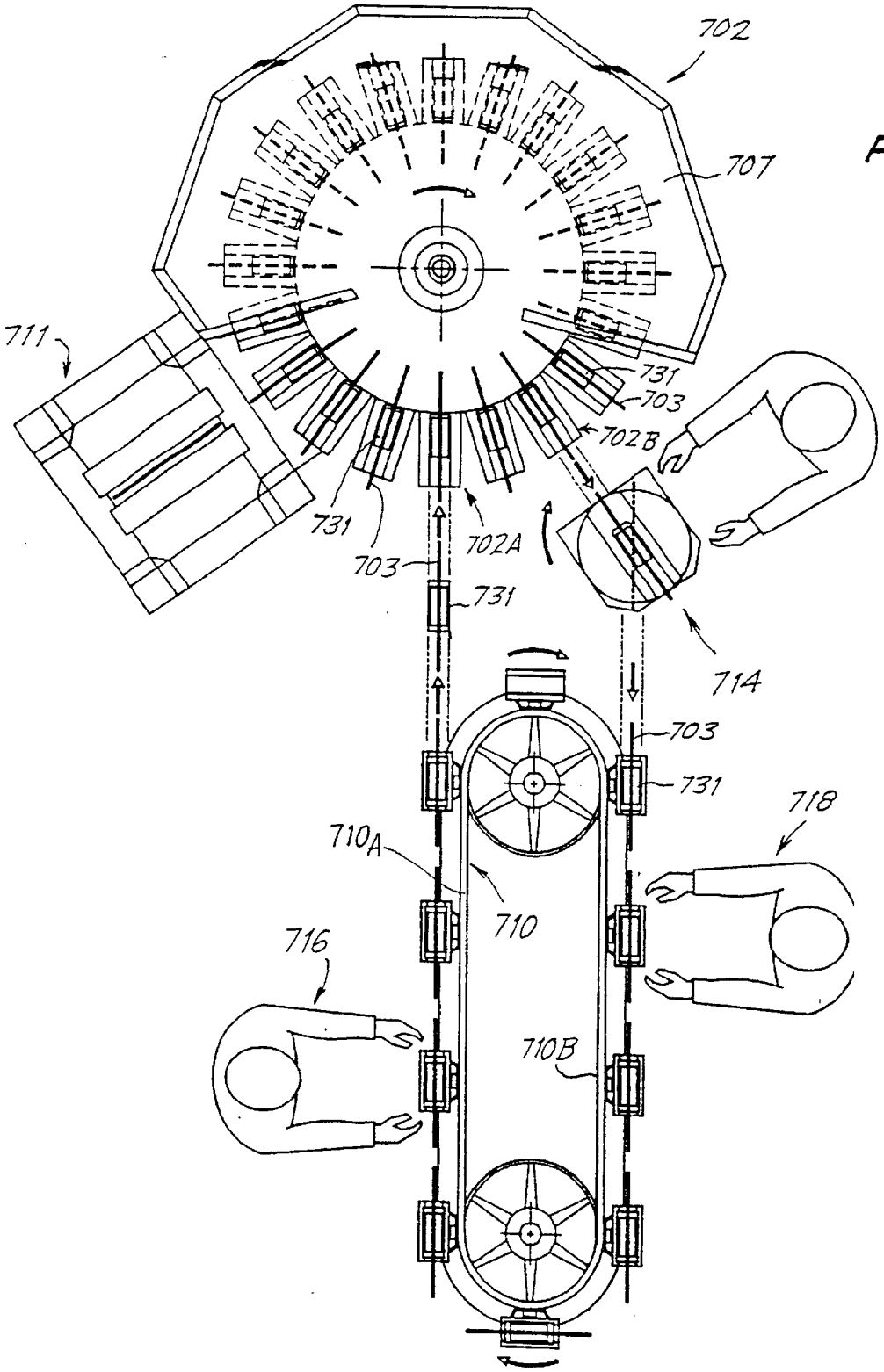
Figure 24:
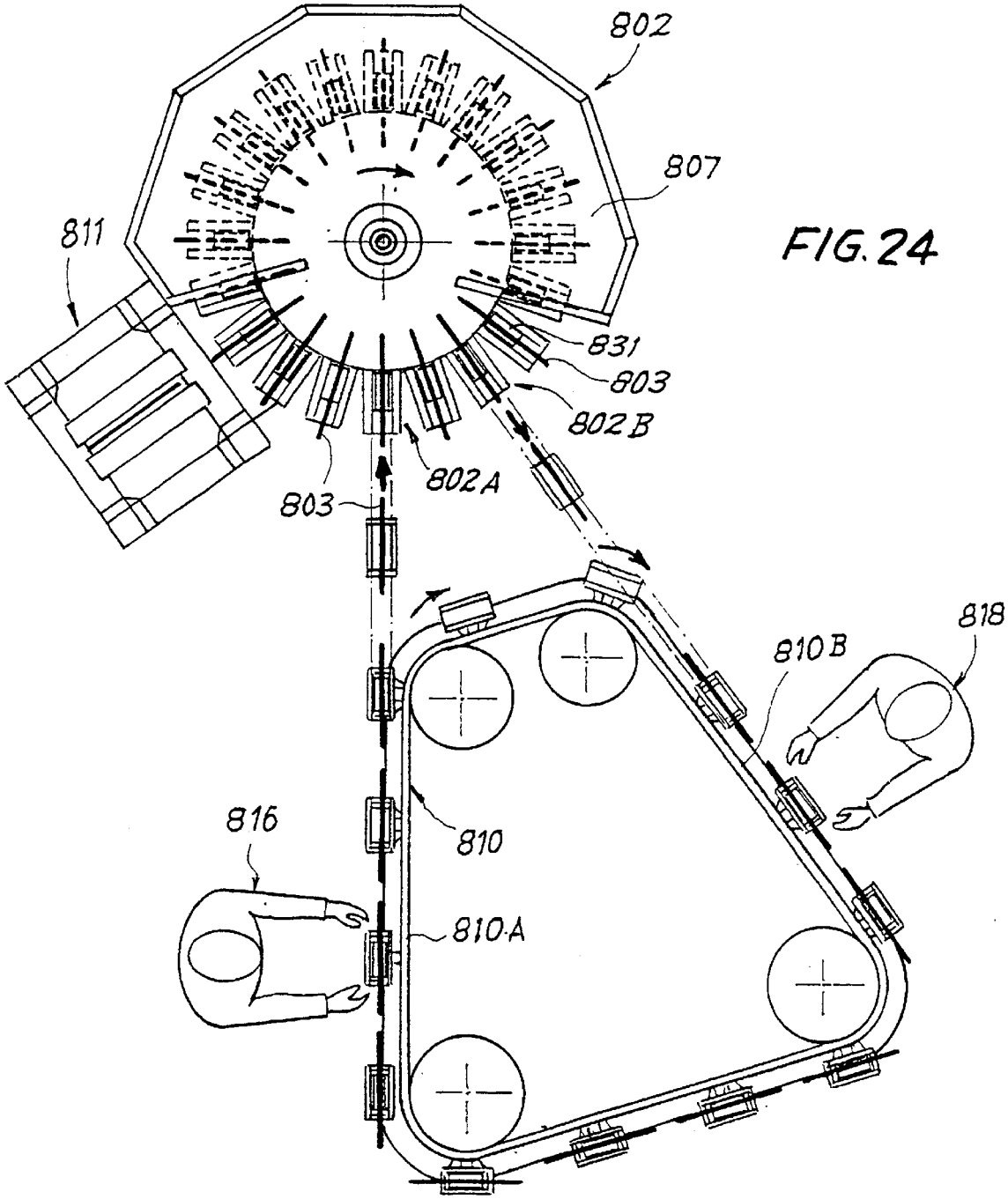

FIGS. 23 and 24 show equipment provided with, respectively, a carousel 702, 802, complete with a setting chamber 711, 811 and a drying oven 707, 807, in a similar way to that described with respect to FIGS. 1 and 2. The carousels 702, 802 are supplied with forms 703, 803 (complete with corresponding supports 731, 831) by means of corresponding conveyor belts 710, 810, each of which receives the forms with the treated garments from the corresponding carousel 702, 802. The transfer from the carousel to the belt and in the opposite direction is carried out directly by a radial movement device of the type 33 shown in FIG. 2, if a straight run of the belt is aligned radially with respect to the carousel, as in the case of the runs 701A; 810A, 810B, in the cases of FIG. 23 and FIG. 24 respectively. If the run of the conveyor belt in question is not radially aligned with the relevant station of the carousel, as in the case of the run 710B in FIG. 23, a device 714 for movement with rotation of the form, similar to the device 514 described previously, is additionally used for the transfer. Thus it is possible to place close to said conveyor belts, which, like the carousels, are also made to advance by steps, a plurality of work stations, such as those 716, 718; 816, 818, for garments which require particularly long operating times which would tend to block the operation of the equipment.

It is to be understood that the drawing shows only an example provided solely as a practical demonstration of the invention, which may be varied in its forms and arrangements without departure from the guiding principle of the invention. The presence of any reference numbers in the attached claims has the purpose of facilitating the reading of the claims with reference to the description, and does not limit the scope of the protection represented by the claims.

What is claimed is:

1. Equipment for the inspection and pressing of knitted products such as pantyhose, bodies and other knitted garments, comprising a carousel equipped with a plurality of forms designed to receive the products and rotate with intermittent motion to progressively present each of the forms to stations for loading and inspecting the product, for heat treatment in a chamber and for discharge, characterized in that it comprises: on the carousel, a plurality of units positioned close to each other and each forming guide means for the radial sliding of a sliding support on which the corresponding form lies in an approximately radial plane; servo mechanisms for radially moving said support outside the carousel and within the carousel, at least at the loading, setting and discharge stations; and, outside the carousel, apparatus for the loading and inspection, for the setting and for the discharge of the garments.

2. Equipment according to claim 1, characterized in that the setting apparatus extending in two half-shells to form the setting chamber is orientated to house the form moving in a radial plane.

3. Equipment according to claim 1, characterized in that a plurality of said servo mechanisms are fitted in fixed locations around the carousel, said servo mechanisms being angularly spaced from each other by whole-number multiples of the angular interval of the forms on the carousel.

4. Equipment according to claim 1, characterized in that the form is maneuverable at said loading and inspection station about a vertical axis by the operator into specified and/or preferred angular positions.

5. Equipment according to claim 4, characterized in that the form is positioned angularly at said discharge station to present the product to a discharge apparatus.

6. Equipment according to claim 2, characterized in that at the setting station the form and/or at least one of the half-shells are movable in a direction orthogonal to the radial plane of movement of the form, to achieve the joining of the two half-shells to form the setting chamber surrounding the form.

7. Equipment according to claim 6, characterized in that the movable half-shell comprises a projection capable of moving the form in said direction to press it against the other half-shell, overcoming the action of an opposing spring, the radially orientated slide which supports the form being fixed to a sliding support guided orthogonally to the plane of the form.

8. Equipment according to claim 1, comprising a tunnel oven for drying, into which the forms move after the setting station, characterized in that the forms move in said tunnel in a radial configuration with respect to the axis of the carousel and are close to each other.

9. Equipment according to claim 8, characterized in that said tunnel oven consists of modular sectors having an angular dimension in plan view which is a multiple of the interval of the forms.

10. Equipment according to claim 1, characterized in that for each form said guide means for the radial movement of the forms comprise an articulated quadrilateral which is movable in a radial plane with respect to the carousel, and which has two opposite sides fitted respectively to the carousel and to said support of the form; and in that one of the other sides of the quadrilateral, or an extension thereof, is coupled mechanically to said servo mechanisms for the radial movement of the forms.

11. Equipment according to claim 10, characterized in that said articulated quadrilateral is a parallelogram, for moving the form radially without angularly changing its configuration in the radial plane in which it lies.

12. Equipment according to claim 1, particularly for the inspection and setting of knitted garments such as bodies, undershirts or similar, characterized in that it comprises forms provided with lateral extensions on which the shoulder straps of the garment can be hooked, and, at a discharge station, a device for automatically removing the garments from the forms, this device comprising a first moving element which carries two fingers operated by an actuator and capable of moving apart the shoulder straps of each body and thus detaching them from said lateral hooking extensions of the form, a second moving element comprising lateral pressers for the garment on the sides of the form, which can be operated by means of a corresponding actuator, and an upper clamp capable of disengaging the part of the knitted garment opposite the shoulder straps from the form, said first and second moving elements being integral with a carriage which runs on a vertical guide in synchronization with the movement of said upper clamp, to facilitate the disengagement of the body from the form.

13. Equipment according to claim 1, characterized in that each of said forms comprises two elements extending in corresponding planes parallel to a radial plane of the carousel and close to it, these planes being juxtaposed with a certain distance between them so that they can receive respective legs of a pantyhose, the said elements being fixed to said support for the radial movement of the forms.

14. Equipment according to claim 13, characterized in that it comprises a device for automatically loading the pantyhose onto the forms in proximity to the carousel.

15. Equipment according to claim 13, characterized in that blocks which reduce the internal volume of the chamber may be fixed within the setting chamber to enable this volume to be adapted to the dimensions of the forms in such a way as to limit the volume of steam supplied for each knitted garment.

16. Equipment according to claim 1, characterized in that, at least at one station for the removal of the forms and their supports from the carousel and their re-insertion into it, there is provided a system capable of receiving and supporting a predetermined number of forms, to provide a holding area for them and to permit the execution of any necessary supplementary operations on the knitted garments fitted on the form, including the loading of the garments onto the forms and their discharge from them.

17. Equipment according to claim 16, characterized in that said system comprises, near to said first carousel, a second carousel rotating in steps and capable of receiving from the first carousel, by the use of transfer means, the moving supports complete with the corresponding forms and the treated garments, the second carousel acting as a buffer and a support for the execution of any necessary further operations on said garments and feeding a station for discharging said garments from the forms and a subsequent station for transferring from the second carousel to the first, by further transfer means, the supports and the forms freed from the garments.

18. Equipment according to claim 17, characterized in that said means for transferring the supports with the forms from one carousel to the other comprise at least one orientating device capable of rotating the supports by an actuator through an appropriate angle about a vertical axis, to allow them to be removed radially from the carousel from which they are taken and inserted radially into the carousel to which they are to be transferred.

19. Equipment according to a claim 18, characterized in that said actuator is disengageable to allow the free angular orientation of the form for manual loading and inspection of the knitted garment on the form.

20. Equipment according to claim 16, characterized in that, on the second carousel, the forms are rotatable about their own axes and spaced angularly to allow an angular rotation of 360° thus enabling the knitted garments to be loaded on the forms, discharged from them, or inspected on them.

21. Equipment according to claim 16, characterized in that a loading or discharge device is provided and interacts with a corresponding station of a carousel into which a support with the corresponding form is temporarily transferred by means of one of said servo mechanisms for the radial movement of the forms, to allow the knitted garment to be loaded onto the form or discharged from it.

22. Equipment according to claim 16, characterized in that said system also comprises at least one belt conveyor capable of transferring to a carousel, or of receiving from it, at corresponding transfer stations, the supports with the corresponding forms to allow the garments to be loaded or discharged simultaneously by more than one operator.

23. Equipment for the inspection and steam pressing of knitted products; the whole as described above and represented by way of example in the attached drawing.

24. An apparatus for processing garments, the apparatus comprising:

a carousel rotatable about a carousel axis;

a plurality of guides arranged around said carousel;

a plurality of forms, each of said forms being planar and holdable of one of the garments; said each of said forms includes a sliding support receivable in said plurality of guides, said sliding supports and said guides being arranged to hold said forms substantially radially on said carousel with respect to said carousel axis, said sliding supports and said guides also being arranged to slide said forms substantially radially on said carousel into and out of said carousel, said carousel rotating with said forms held substantially radially;

a plurality of processing stations arranged around said carousel and radially outside said carousel.

25. An apparatus in accordance with claim 24, further comprising:

a servo arranged between said carousel and one of said processing stations, said servo substantially radially sliding one of said forms out from one of said guides into said one processing station and back into said one guide.

26. An apparatus in accordance with claim 24, wherein:

said plurality of processing stations include a loading station, an inspection station, a setting station, and a discharge station completely outside said carousel.

* * * * *